US007568760B1

(12) United States Patent
Lodes

(10) Patent No.: US 7,568,760 B1
(45) Date of Patent: Aug. 4, 2009

(54) APPARATUS FOR CONVERTING AN ARMCHAIR FOR USE AS A COMPUTER WORKPLACE

(76) Inventor: Mark P. Lodes, 9000 Meadowbrook La., St. Louis, MO (US) 63114

( * ) Notice: Subject to any disclaimer, the term of this patent is extended or adjusted under 35 U.S.C. 154(b) by 157 days.

(21) Appl. No.: 11/809,978

(22) Filed: Jun. 4, 2007

(51) Int. Cl.
*A47C 7/62* (2006.01)
*A47B 39/00* (2006.01)

(52) U.S. Cl. ..... 297/217.7; 297/188.21; 297/174 R; 297/172; 297/173

(58) Field of Classification Search ..... 297/217.1, 297/217.4, 217.7, 174 R, 173, 172
See application file for complete search history.

(56) References Cited

U.S. PATENT DOCUMENTS

| | | | | |
|---|---|---|---|---|
| 607,905 | A | 7/1898 | Wyngaard | |
| 1,914,721 | A | 6/1933 | Isaif | |
| 4,461,470 | A | 7/1984 | Astroth et al. | 272/17 |
| 4,880,270 | A * | 11/1989 | Cooper | 297/188.21 |
| 5,056,864 | A | 10/1991 | Cooper | 297/188 |
| 5,106,153 | A | 4/1992 | Durling | 297/232 |
| 5,169,210 | A | 12/1992 | Fricano | 297/188 |
| 5,177,616 | A | 1/1993 | Riday | 358/254 |
| 5,222,780 | A | 6/1993 | Reh et al. | 297/194 |
| 5,275,482 | A | 1/1994 | Grant | 312/235 |
| 5,292,173 | A | 3/1994 | Lambert | 297/161 |
| 5,326,104 | A | 7/1994 | Pease et al. | 273/138 |
| 5,480,213 | A | 1/1996 | Sproule | 297/232 |
| 5,489,142 | A | 2/1996 | Mathieu | 297/327 |
| 5,547,247 | A | 8/1996 | Dixon | 297/145 |
| 5,612,718 | A | 3/1997 | Bryan | 345/168 |
| 5,653,499 | A | 8/1997 | Goodall | 297/170 |
| 5,765,911 | A | 6/1998 | Sorenson | 297/173 |
| 5,779,305 | A * | 7/1998 | Hocking | 297/217.4 |
| 5,897,166 | A | 4/1999 | Tsai | 297/353 |
| 5,909,934 | A * | 6/1999 | McGraw | 312/223.3 |
| 6,056,363 | A * | 5/2000 | Maddox | 297/325 |

(Continued)

*Primary Examiner*—David Dunn
*Assistant Examiner*—Erika Garrett

(57) ABSTRACT

A kit for converting a standard easy chair with arms for use as a computer workplace, such kit including a base member, a columnar element, a keyboard storage assembly, and a mouse storage assembly and pad area. The base member has a low profile configured to fit and extend beneath at least a portion of the bottom of the easy chair and includes a stabilizing portion to maintain the chair and the base member in a generally stable relationship with one another, with at least one side portion of the base member extending beyond a side of the arm chair to form a base support element. The columnar element has a bottom portion designed to be complementarily engageable with the base support element, a body portion, and an upper end, with the body portion extending upwardly from the base support element to the upper end which is positionable generally adjacent to and extending to above the level of one arm of the easy chair. The keyboard storage assembly is associatable with the columnar element and includes at least one arm element positionable at a height along the columnar element above the level of such arm of the arm chair and securable to the columnar element, with the arm element projecting generally laterally from said columnar element and including a keyboard retaining portion for engagably receiving and holding a keyboard. The mouse storage assembly and pad area preferably includes a compartment body sized to accommodate a mouse therein, a fitted lid therefor, and a mounting assembly for securing the mouse storage assembly and pad area to an arm of the easy chair, such as a forward extension of that arm.

30 Claims, 15 Drawing Sheets

U.S. PATENT DOCUMENTS

| | | | | |
|---|---|---|---|---|
| 6,102,476 | A * | 8/2000 | May et al. | 297/217.3 |
| 6,145,926 | A * | 11/2000 | Lin | 297/217.3 |
| D441,968 | S | 5/2001 | Lin | D6/336 |
| 6,270,157 | B1 * | 8/2001 | Kapushinski | 297/170 |
| 6,425,631 | B1 * | 7/2002 | Lin | 297/173 |
| 6,598,934 | B1 | 7/2003 | Anderson | 297/162 |
| 6,726,276 | B1 * | 4/2004 | Tholkes et al. | 297/172 |
| 6,916,065 | B2 * | 7/2005 | Park | 297/217.1 |
| 7,017,988 | B2 * | 3/2006 | Tornero et al. | 297/145 |
| 7,134,719 | B2 * | 11/2006 | Moglin et al. | 297/217.3 |
| 2003/0151277 | A1 | 8/2003 | Chen | 460/111 |
| 2004/0155493 | A1 | 8/2004 | Baru | 297/188.2 |

* cited by examiner

APPARATUS FOR CONVERTING AN ARMCHAIR FOR USE AS A COMPUTER WORKPLACE

FIELD OF THE INVENTION

The present invention is directed to an apparatus for use in converting an armchair for use as a computer workplace.

BACKGROUND OF THE INVENTION

As computers and their usage have increased in popularity and have become commonplace not only in the business environment, but also in home environments and for leisure activities, manufacturers and users have sought ways to not only make the computers more user friendly, but also ways to improve the ergonomics associated with the use of the computers and the comfort of users when they are using computers.

Despite various advances that have been made over the years relative to the manner of input by users of data and information, most computers still require or are designed to receive inputs from a keyboard or keypad of some type, as well as a mouse or like device, and employ a monitor or display device of some type.

In their use of computers, particularly in a home or non-office environment, various computer users have opted to employ comfortable armchairs, including easy chairs and reclining chairs, as they engage in work or play involving a computer. Such usage has been constrained in various respects due to the size and interconnection requirements for the components of typical computer systems, and difficulties in positioning or incorporating a comfortable chair into the computer system, particularly in a way that would allow the user the most comfort as he or she makes use of the computer.

Typically, with desktop-like computer systems, most users would position their chairs in front of a monitor positioned upon a desk or like item, with a keyboard and mouse also positioned upon the desk, and with those components connected to the CPU unit of the system. Users found that they could sometimes position the chair at a more distant location and/or could recline a chair or configure the chair for comfort provided that some arrangement could be made to conveniently access the keyboard or mouse, including by moving the keyboard and mouse to the user's position in the chair. Because of the size of the monitor and its connection to the CPU unit, however, and because of connection requirements for the keyboard and mouse, the positioning and configuration of a comfortable chair for use in a computer system remained less then ideal.

Although various of these constraints have become less problemsome with the increasing availability of laptop computers and with wireless keyboards and pointing/selection devices, many computer users still prefer, when possible and circumstances are appropriate, to employ the larger, standard computer systems with their generally greater potential storage capacities, larger and generally more familiar and less cramped keyboards, and generally greater adaptability and expandability with respect to addition system components such as CD and DVD drives, add-on external floppy and hard drives, a variety of peripherals, and other components and accessories.

To address these concerns and desires, various devices have been developed, including specialized furniture for computer systems. Some of such specialized furniture have been chairs which have been designed to include structures and features so as to allow the incorporation into the chair of various components of a computer system and/or the inclusion in the chair of structure or features to accommodate components of a computer system and/or the use of such a system by the user from the chair. Appendages or monitor supporting arms of various types have sometimes been proposed as part of such chair constructions or as add-on items.

For many computer users, however, such specialized furniture and add-on components therefor have failed to meet the expectations or desires of such users, especially when they have already had a comfortable chair that they wished to continue to use and with which they were happy and in which they found comfort.

SUMMARY OF THE INVENTION

Accordingly, the present invention is directed to an assemblage or kit of materials that can be employed to convert standard arm chairs, especially easy chairs and reclining chairs of various types, for use as computer workplaces, and to the resulting constructions, when the elements of the kit are assembled with one another and an arm chair.

The conversion assemblage includes a base member having a low profile configured to rest upon a floor or ground surface and, preferably, to fit and extend beneath at least a portion of the bottom of the easy chair or to be associated with one or more of the chair legs to maintain the chair and the base member in a generally stable relationship with one another, with at least one side portion of the base member extending beyond a side of the arm chair to form a base support element. A columnar element having a bottom portion designed to be complementarily engageable with the base support element is provided and includes a body portion extending upwardly from the base support element when the columnar element is engaged therewith to an upper end positionable generally adjacent to and extending to above the level of the arm of the easy chair. A keyboard storage assembly is associatable with the columnar element and includes at least one arm element positionable at a height along the columnar element above the level of such arm of the arm chair and securable to the columnar element, with the arm element projecting generally laterally from said columnar element and including a keyboard retaining portion for engagably receiving a keyboard and maintaining the keyboard when it is desired to store the keyboard, preferably with the keyboard being in a generally vertical plane adjacent the columnar element and the side of the easy chair when so stored. A mouse storage assembly and pad area that preferably includes a compartment body defining a compartment sized to accommodate a mouse therein and a fitted lid therefor to cover and close the compartment is provided for mounting to or at an arm of the arm chair, such as a forward extension of the arm.

In addition, and optionally, a monitor support arm and platform may be provided, as well as additional columnar supports for other computer accessory devices, such as additional hard drives, CD drives, DVD drives, and other devices that a user may want to keep within easy reach. Mounting or storage positions may also be provided with or associated with the base member for the positioning and/or storage of the computer CPU unit and/or other associated equipment, including such items as speakers, modems, routers, and switches and gateways of various types and designs.

The base member is preferably designed to include a stabilizing portion to maintain the base member in a generally stable position beneath the easy chair when the base member is so positioned, and opposed side portions, with the side portions preferably being adjustably spaceable from one another to position the opposed side portions such that least an outer portion of one of said side portions extends beyond the side of the easy chair to form the base support element. The stabilizing portion may be of a plate-like design upon which the arm chair may rest or of a frame or lattice design, and may have apertures through which the legs or base of the chair may extend to rest upon an underlying floor surface. The stabilizing portion may be weighted sufficiently to generally maintain its position and location upon the underlying floor surface and/or may be attachable to the legs, base, or underside of the arm chair.

The arm element of the keyboard storage assembly can take various forms but includes at least a keyboard retaining portion, such as a storage compartment, in which the keyboard can be retained and stored. In one embodiment, the arm element and the keyboard retaining portion may be disposed in a fixed position such that the keyboard can be positioned in a keyboard storage compartment with its longer side aligned generally perpendicular to the columnar element and with its shorter side aligned generally parallel to the columnar element, with the arm element being generally horizontally movable relative to the columnar element to position the keyboard storage assembly generally in front of a user seated in the chair when use of the keyboard is desired by the seated user and to reposition the arm element to a position generally parallel to the arm of the arm chair at other selectable times. In other embodiments, pivotal connection assemblies may permit the keyboard storage compartment to also be pivoted, in a further degree of movement, from a generally horizontal position to a generally vertical position. With the more advanced embodiments, the arm element then be moved from a storage condition in which the keyboard is in a generally vertical position to a generally horizontal position, and the arm element can then be horizontally rotated relative to the columnar element to position the keyboard in front of the seated user. Additional adjustment mechanisms may permit the keyboard to be tilted and otherwise reoriented in front of the user for use thereby. To such ends, the noted arm element may be of an articulated or reticulated design having a first or upper arm portion secured to the columnar element and a second or forearm portion connected to the upper arm portion. The keyboard storage assembly preferably includes a relatively flat surface upon the keyboard may be positioned for use when the assembly is positioned in front of a user in the chair, and in some preferred embodiments, such surface and the keyboard positioned thereon may be slidably adjustable towards or away from the seated user to a desired position.

The compartment body of the mouse storage assembly and pad area preferably includes a lid that is openable and closable as desired by a user and which has a generally flat upper surface suitable for use as a mouse pad area when the lid is closed and the mouse is in use. The mouse storage assembly and pad area includes a mounting assembly for mounting the mouse storage assembly and pad area to the arm chair, preferably, but not necessarily, as a forward extension of an arm of the chair, with the upper surface of such a lid being generally alignable with the top of the arm of the chair when the top of the chair arm is in a generally horizontal position, or to the base member, such as by way of a pole or like member positioned to provide the mouse at an accessible position to a seated user. The mounting assembly, while preferably configured to facilitate mounting of the mouse storage assembly and pad area to an arm of the armchair may also be configured for mounting to the chair base or seat or to other chair structure.

A biasing assembly may be employed to maintain the mouse pad area generally horizontal as the arm position changes, such as might occur when some reclining chairs are positioned in a reclining state. Such biasing assembly may take various forms and, in one embodiment, may include a spring or other first biasing element associated with the chair arm and the mouse storage assembly and pad area to bias the mouse compartment upwardly and a tensioning element extending between the base assembly and the mouse compartment to restrict upward movement of such mouse compartment and to act against the bias provided by the first biasing element as the position of the chair arm changes and the forward mouse compartment begins to rise when the reclining chair is placed in a reclining configuration.

Accordingly, a principal object of the present invention is to provide an assemblage or kit of materials that can be readily and easily employed to convert standard air chairs for use as computer workplaces, and to teach the use of such materials to effect such a conversion.

DETAILED DESCRIPTION OF THE PREFERRED EMBODIMENTS

Figure 1:
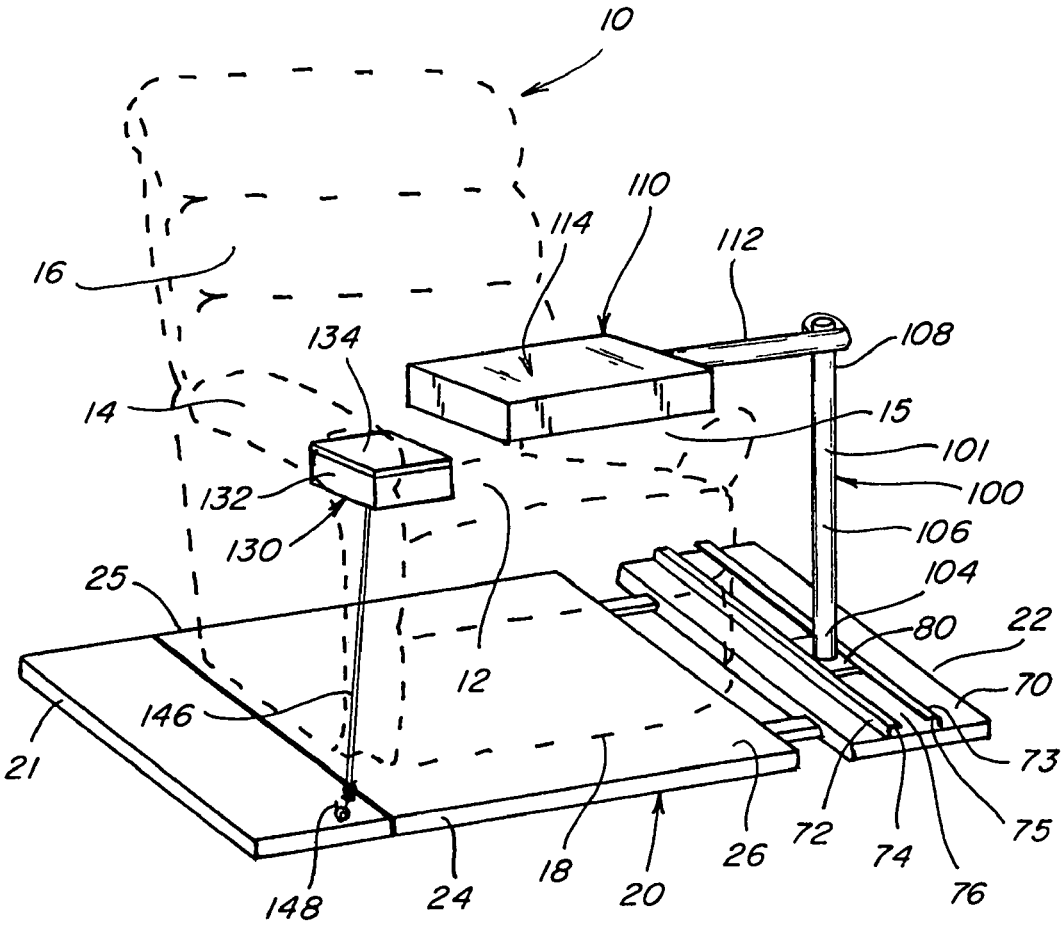
FIG. 1 is a perspective view depicting a preferred form of the invention in association with an easy chair, shown in phantom, with which the invention is employed.

Referring now to the drawings, wherein like numerals refer to like items, FIG. 1 depicts, in phantom, an arm chair 10 of known easy chair design which includes a seat portion 12, arm portions 14 and 15, a back portion 16, and a base portion 18 which rests upon an underlying surface.

The present invention comprises various components that may be provided in a kit form for use with the easy chair 10 to convert such chair for use with a computer system. Principal among such components are a base member 20, a columnar support element 100, a keyboard storage assembly 110, and a mouse storage assembly and pad area 130.

Base member 20, having opposed side portions 21 and 22 and opposed front and back portions 24 and 25, is shown disposed beneath the bottom of chair 10 and, in this preferred embodiment, includes a stabilizing portion 26 that is so associated with the base portion 18 of chair 10 to maintain the base member 20 in a stable position relative to, and with this embodiment, beneath, the chair 10. With the base member 20, the stabilizing portion is a central plate-like construction weighted sufficiently to maintain the base member 20 in a relatively fixed position upon an underlying surface and upon which the base 18 of the chair rests or to which the base of the chair is attached so as to maintain the chair in a relatively stable position relative to the base member.

Figure 2:
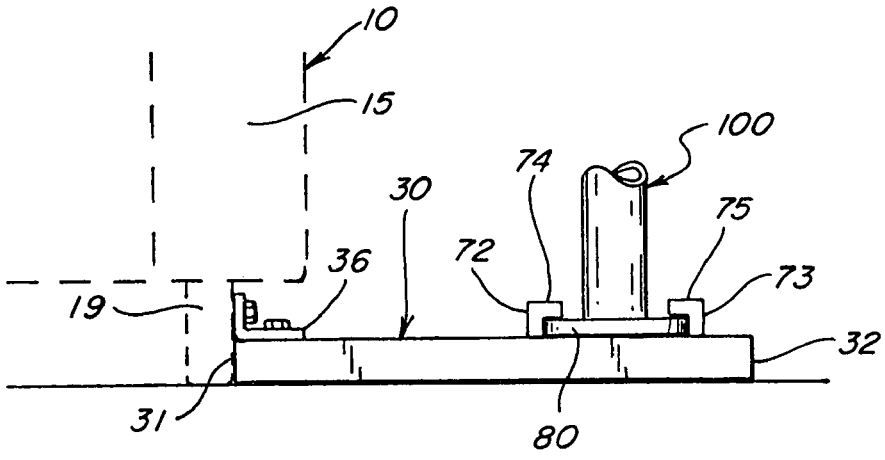
FIG. 2 depicts a front view of an alternative base member construction as connected to a leg of the easy chair.

FIG. 2 depicts an alternative base member 30 sized and configured to fit and extend beneath only a portion of the bottom of the easy chair 10. Such base member 30 includes inner and outer sides 31 and 32, and inner side portion 31 is shown positioned adjacent a portion of the leg or frame 19 of the base 18 of the easy chair 10. An L-shaped bracket 36 is shown connected to the base member 30 and to chair leg or frame 19 which acts as a stabilizing portion to maintain the base member 30 in a stable position relative to the chair 10.

Attachment of the base member to the chair can be effected by a plethora of known connection devices and methods, and the particular devices or methods employed are not considered critical to the invention.

Figure 3:
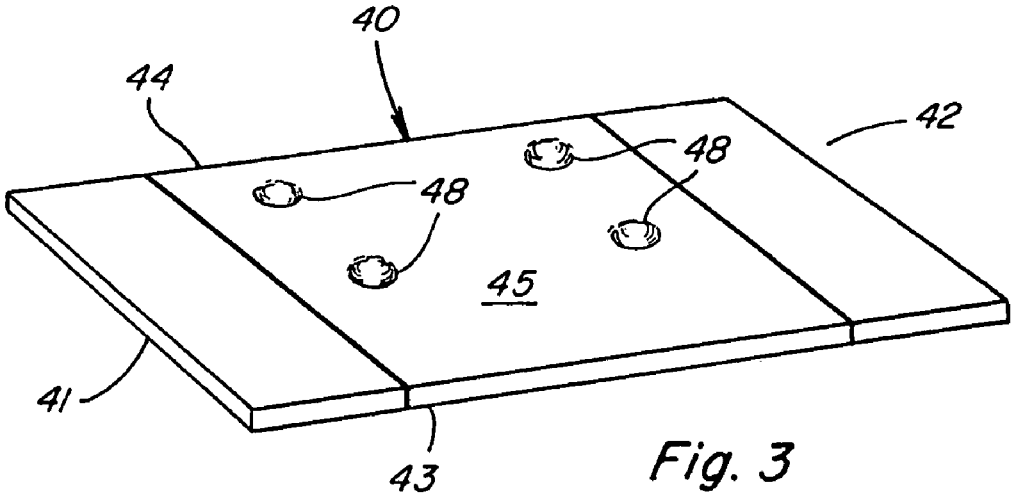
FIG. 3 depicts a different alternative base member construction.
Figure 4:
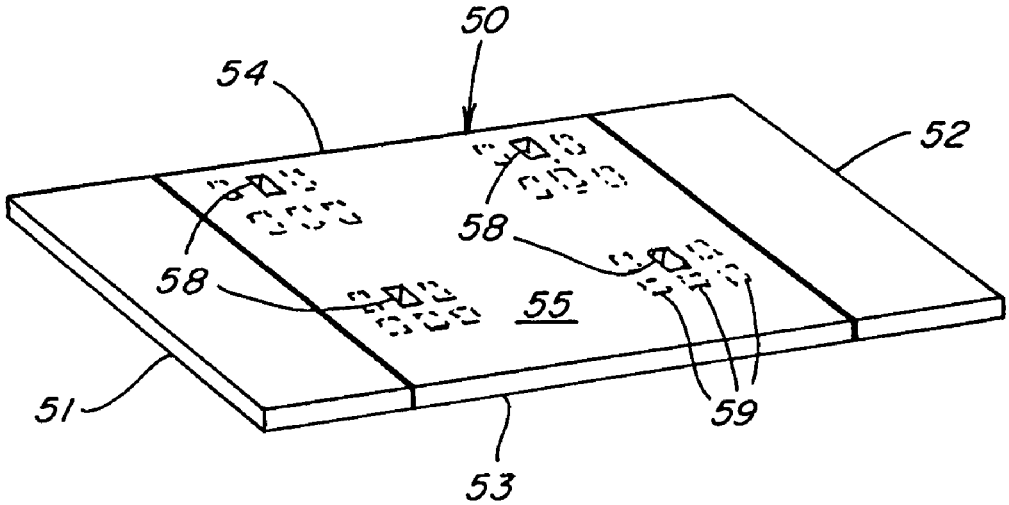
FIG. 4 depicts another alternative base member construction.

Although it is preferred that the base member be attached in some manner to the base portion 18 of the chair 10, such attachment is not necessarily required, depending upon the particular design and configuration of the base member, especially when the base member is designed and configured, when positioned beneath a chair, to maintain the base member and chair in a stable relationship with one another and upon the underlying floor. In such regard, it should be appreciated that the base member could take the form of plate-like structures 40 or 50, such as are depicted in FIGS. 3 and 4, with respective side portions 41, 42 and 51, 52, respective front and back portions 43, 44 and 53, 54, and respective central portions 45, 55, and depressions 48 or cut-outs 58 therein in which or through which the legs of a chair could be positioned. The overall weight of such base members 40 and 50, including the weight contributed by the central portions 45 and 55, acts to stabilize the base member in a fixed position upon the underlying floor, and the weight of the chair, when positioned with the legs of the chair positioned resting in the depressions 48 or extending through the cut-outs 58 of the base members 40 and 50, acts to maintain the chair in a fixed relationship with the base members 40 and 50. Preferably, the depressions and cut-outs of such types of base members are sized to accommodate the legs or base portions of a chair without excessive free play around the legs or base portion that would permit undue movement of the chair relative to the base member.

Base members such as base member 50 may be designed to include knock-out or removable portions, such as knock-out portions 59 as depicted in FIG. 4, that may be customizable by a user to accommodate the legs or base portion of the user's particular chair type.

If desirable, separate or additional weighting elements may also be employed to further stabilize the base member to hold it in a fixed location, and a surface preparation may be utilized or applied to the area of a base member upon which the legs of the chair will rest to further inhibit sliding movement of the legs upon the base member.

Figure 5A:
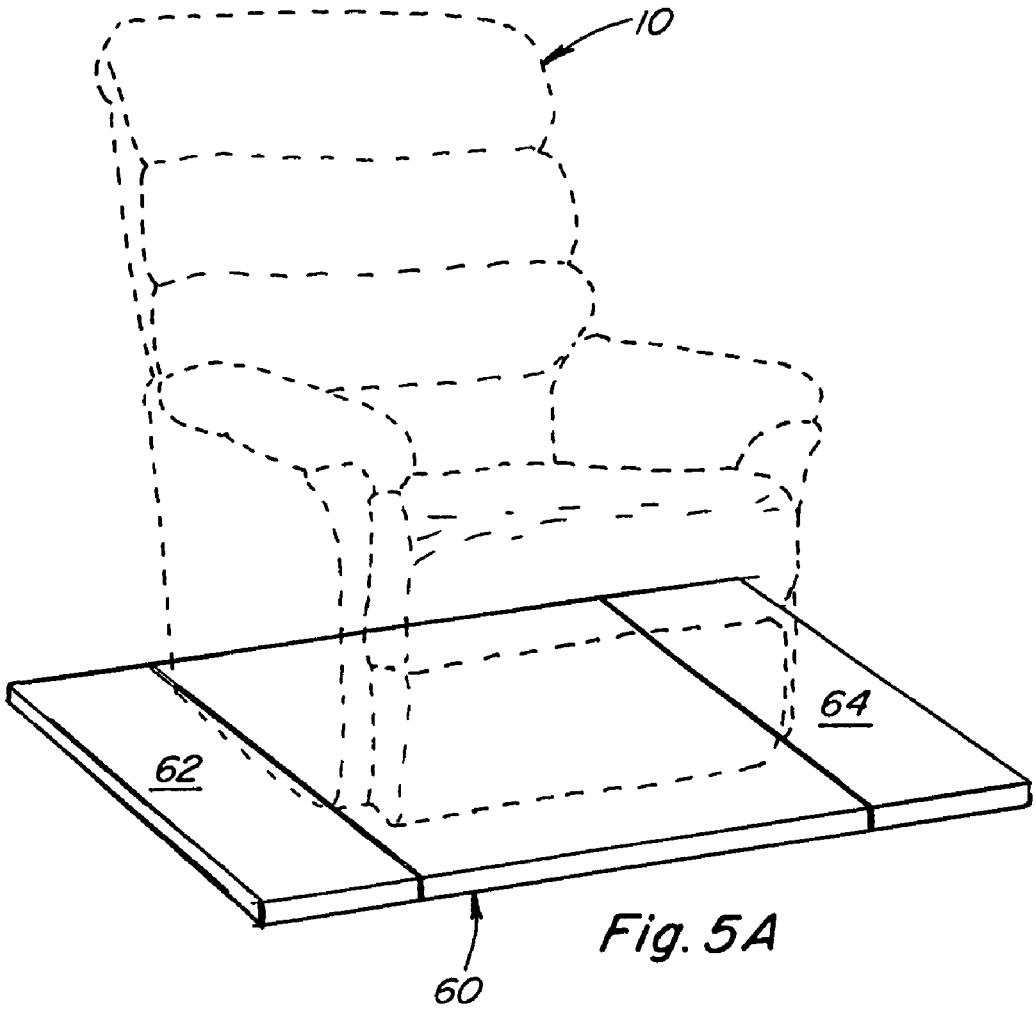
FIGS. 5A and 5B depict a base member embodiment that includes adjustably extendable side portions.
Figure 5B:
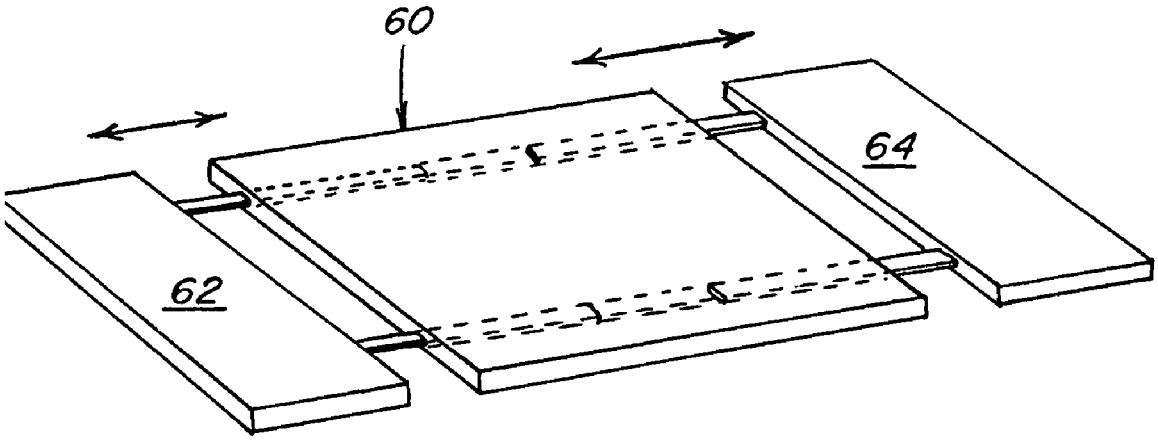

FIGS. 5A and 5B depict one form of base member 60 that may be utilized and which includes opposed side portions 62 and 64 which are configured to be adjustably extendable and spaceable from one another to position at least the outer portion of one of said side portions to extend beyond the side of the easy chair to form the base support element. Numerous designs and configurations that permit adjustable placement of two interconnected component portions of a construction from one another are well known, and all such designs and configurations that are adaptable to a base member for the present invention may be advantageously employed.

While the base member 60 depicted in FIGS. 5A and 5B includes opposed side portions 62 and 64 that are extendable beyond both sides of the chair and which are connected through the central portions of the base members or by adjustable interconnections therebetween, such is not necessarily required by the subject invention, and the base member may be associated with only one side of the chair or may, if base support is desired on both sides of the chair, include two or more separate component portions, such as two separate elements, each of which may be associated with and connected to chair legs on opposite sides of the chair, including elements similar to base member 30 of FIG. 2.

With the construction of FIG. 1, the side portions of the base member are disposed such that at least the outer portion of one side portion extends beyond the side of the chair to form a base support portion, such as the base support portion 70 associated with the base member 20 of FIG. 1. As will be appreciated by those skilled in the art, the configuration of the base support portion may take many forms, provided it has the capability of supporting an upwardly projecting columnar element, such as a columnar element that is tubular in shape, but which may be of any convenient configuration, and whose bottom portion may be designed and configured in many ways to be conveniently and complementarily engageable with the base support portion of the base member. For purposes of this and further discussion, the term columnar element should be considered to include all upwardly projecting portions which are suitable for the intended purpose. Additionally, by way of example and not of limitation, the base support portion may include a bracket and pole clamping element for grasping and holding the bottom portion of a pole-like tubular element, an L-shaped bracket securing the bottom portion of a columnar element having a generally polygonal cross-section, or a cavity configured to snugly engage the bottom portion of a pole-like tubular element, or other components that serve a like purpose. Especially with pole-type tubular elements, the bottom portion of the pole-like tubular element and cavities in the base member or attachment elements may be threaded, if desired, to permit threaded engagement therebetween. Furthermore, the columnar element may be formed in several segments, if desired, such as by shorter segments that may be screwed together or otherwise joined or mated together to form a longer segment, or may have a telescopic or extendible configuration, including with a locking mechanism to lock the columnar element to a desired height or in a desired condition.

In one preferred embodiment, such as is depicted in FIG. 1, the base support portion includes a slotted rail construction that has a pair of spaced, longitudinally extending rails 72 and 73 having respective lips 74 and 75 extending towards one another to define a channel cavity 76 within which a shoe element such as the shoe element 80 of columnar element 100 fits in sliding engagement.

In the embodiment depicted in FIG. 1, columnar element 100 is a pole 101, whose bottom portion 104 includes shoe 80 which is complementarily engaged with base support portion 70 of base member 30, in this instance by positioning the shoe 80 within channel cavity 76. Pole 101 also includes a body portion 106 which projects upwardly to an upper end 108 that is generally adjacent to or extends above the level of the arm 12 of chair 10. Pole 101 has a keyboard storage assembly 110 associated therewith, which keyboard storage assembly 110 includes an arm element 112 positionable at a desirable height along the pole 100 and secured thereto. In one basic configuration, the keyboard storage assembly 110 includes a keyboard retaining portion 114 that is positioned generally laterally to the pole 100 and dimensioned to hold and maintain a keyboard disposed therein or attached thereto or associated therewith.

Figure 6:
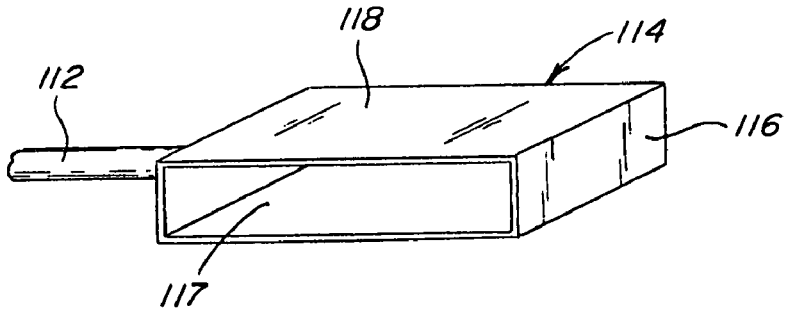
FIG. 6 is a perspective view of a preferred keyboard storage assembly such as it might be viewed by a seated user when the keyboard storage assembly is positioned in front of him.

By way of example and not of limitation, the keyboard storage assembly may include a platform or surface to which a keyboard may be secured by any suitable devices or means, or may include a compartment, either open or closable, in which the keyboard may be placed for storage, such as a storage compartment, box, or drawer unit, or may be of other design and construction for holding and storing a keyboard. In FIG. 1, the keyboard storage assembly is depicted as a storage compartment 116 that is open on one side, as best shown in FIG. 6, to permit the keyboard to be placed therein when the keyboard is not in use. With the storage compartment 116, the keyboard may be removed from the interior storage area 117 and placed upon the top surface 118 when keyboard use is desired, and returned to interior storage area 117 when keyboard use is no longer desired. In other embodiments, a door or closure may be provided to close the open side of storage compartment.

Figure 7:
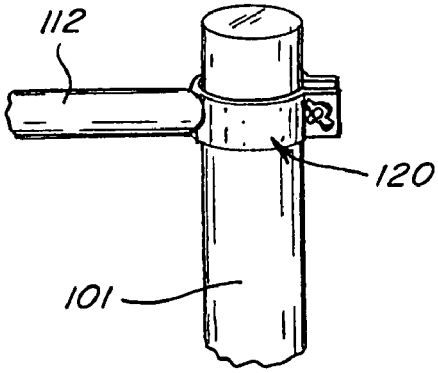
FIGS. 7-9 depict several representative manners of connecting the keyboard storage assembly of FIG. 1 to the columnar element of FIG. 1.
Figure 8:
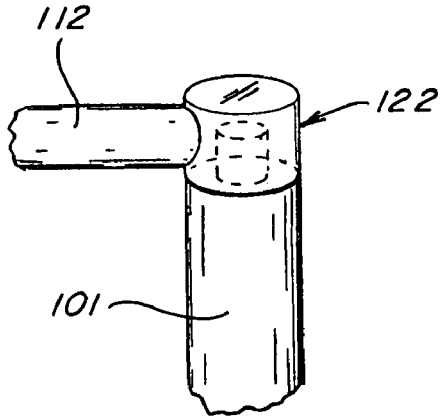
Figure 9:
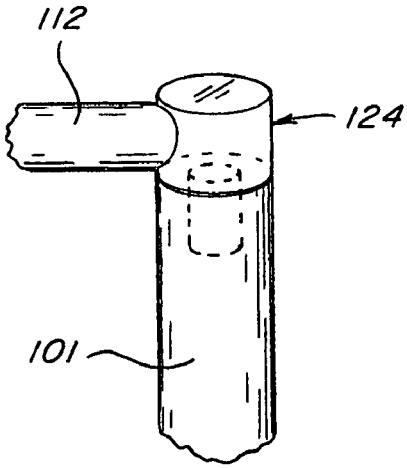
Figure 10:
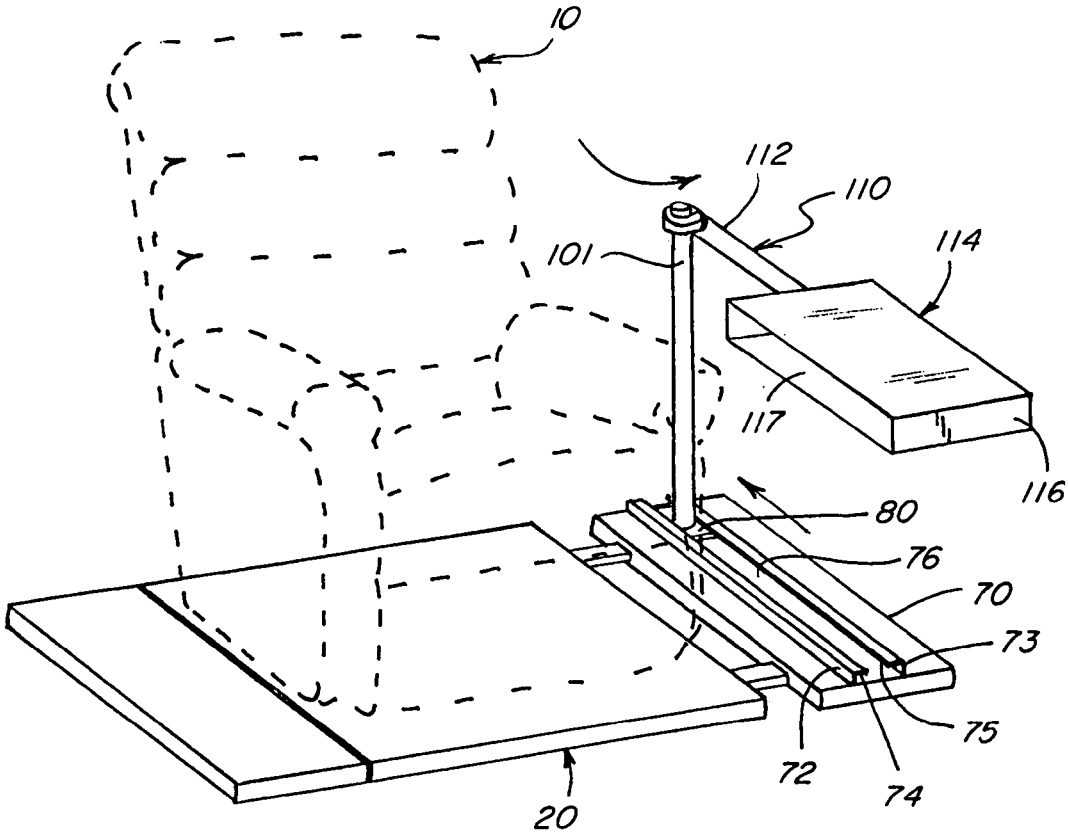
FIG. 10 depicts the keyboard storage assembly of FIG. 1 as it might appear when in a storage position adjacent the side of the easy chair.

In the embodiment of FIG. 1, arm element 112 of the keyboard storage assembly may be secured to pole 101 by any acceptable means sufficient to maintain the arm element at a desirable position. By way of limitation and not of exclusion, several acceptable means are depicted in FIGS. 7-9, including adjustable clamp mounting 120 in FIG. 7, a cap and shoulder mounting 122 in FIG. 8, and a fitted stud coupling mounting 124 in FIG. 9. The particular manner of attachment of the arm element to pole 101 is not considered critical to the invention, and any of multitudinous known methods and constructions could advantageously be employed. With the embodiment of FIG. 1, arm element 112 may be rotated about pole 101 to position keyboard storage assembly 110 generally longitudinally adjacent the arm 114 of chair 10 and shoe 80 may be slideably repositioned within channel cavity 76 to position columnar element 100 and keyboard storage assembly 110 in a storage position, such as is depicted in FIG. 10, that allows a user to access the chair without hindrance by the columnar element 100 and the keyboard storage assembly 110.

In more advanced embodiments, the columnar element and the keyboard storage assembly may include or have associated therewith additional features and capabilities, such as adjustably extendable or telescoping columns and pivoting or gimbaling mechanisms to permit a stored keyboard and the keyboard storage assembly with which it is associated to be freely movable to and positionable for use at a location generally above the seat 12 of the chair 14. In some more advanced forms, the keyboard storage assembly may include a platform, or a compartment whose top surface forms a platform, and an attached arm element, which components are designed and configured to be operable in a fashion similar to that of trays typically associated with the arms of airplane seats that are immediately aft of bulkheads in aircraft. In other embodiments, the keyboard storage assembly, and especially the arm element thereof, may include articulated or reticulated arm portions for repositioning the keyboard storage assembly to a desired location and for maintaining such assembly in that position. In certain more advanced embodiments, the keyboard storage assembly and the platform thereof may be configured to be movable or adjustable by the user, including being tiltable and being slidably adjustable as the chair reclines to maintain the platform at a desirable position in front of the user, such as is possible with existing and well known airline seat tray constructions.

It will be appreciated that many different configurations and devices may be employed as part of the keyboard storage assembly and for the positioning and repositioning of such assembly to desired positions and that, for effective use pursuant to the present invention, the design of the keyboard storage assembly is not necessarily restricted to any particular forms or embodiments, including the particular forms and embodiments discussed herein, so long as the keyboard storage assembly otherwise complies with the requirements therefor as established herein.

The assemblage or kit of materials for converting the chair to a computer workplace also includes a mouse storage assembly and pad area that is designed for mounting to or at an arm of the chair. Typically, for convenience and ease of use, the mouse storage assembly and pad area would be associated with the chair arm opposite the arm with which the keyboard storage assembly is associated, but it could be associated with the same arm if so desired. In FIG. 1, one embodiment of a mouse storage assembly and pad area 120 is depicted in association with the right arm 14 of chair 10, such as might be preferred by a right-handed user.

Figure 11:
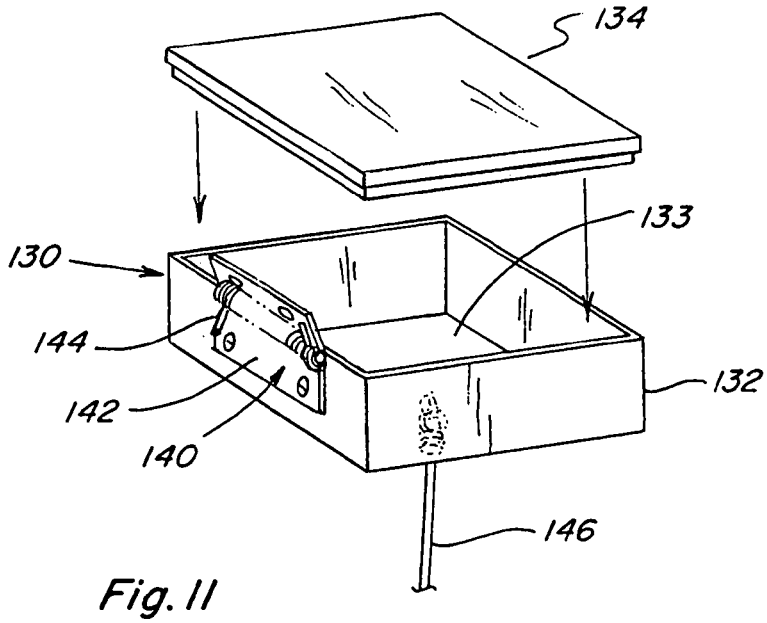
FIG. 11 is a perspective view of the mouse storage assembly and pad area of FIG. 1.

The mouse storage assembly and pad area 130 of the embodiment of FIGS. 1 and 11 includes a compartment body 132 defining a compartment 133 sized to accommodate a mouse therein and a fitted lid 134 therefor to cover and close the compartment. A mounting portion 140 is shown attached to the side of the compartment body and includes a hinged mounting bracket structure 142 for attachment to arm 14 of the chair 10. The hinged mounting structure 142 preferably has associated therewith a biasing element 144 for biasing the compartment body 142 upwardly and away from the front of the arm 14 of chair 10. A tensioning element 146 is also provided and is operably connectable between the compartment body 132 and a lower, preferably fixed, connection point. Typically, such connection point may be located on the base of the chair or the base member 30, such as at connection point 148 in the embodiment depicted in FIG. 1, but could also be located or associated with other portions of the chair, the base member, or the floor, or other structures in different configurations.

The tensioning element 146 is preferably of a length that, when connected to the connection point 148 and to the compartment body 132 while the mouse storage assembly and pad area 130 is attached to arm 12 of chair 10, the tensioning element will restrict movement of the compartment body such as might occur if the attitude, or pitch of the arm 14, were to change, by working against the biasing of the biasing element 144 associated with the hinged mounting bracket structure 142. Typically, the tensioning element may take the form of a bungee chord or like device, although numerous other forms of tensioning elements that serve the intended purpose could be equally as well employed.

Figure 12:
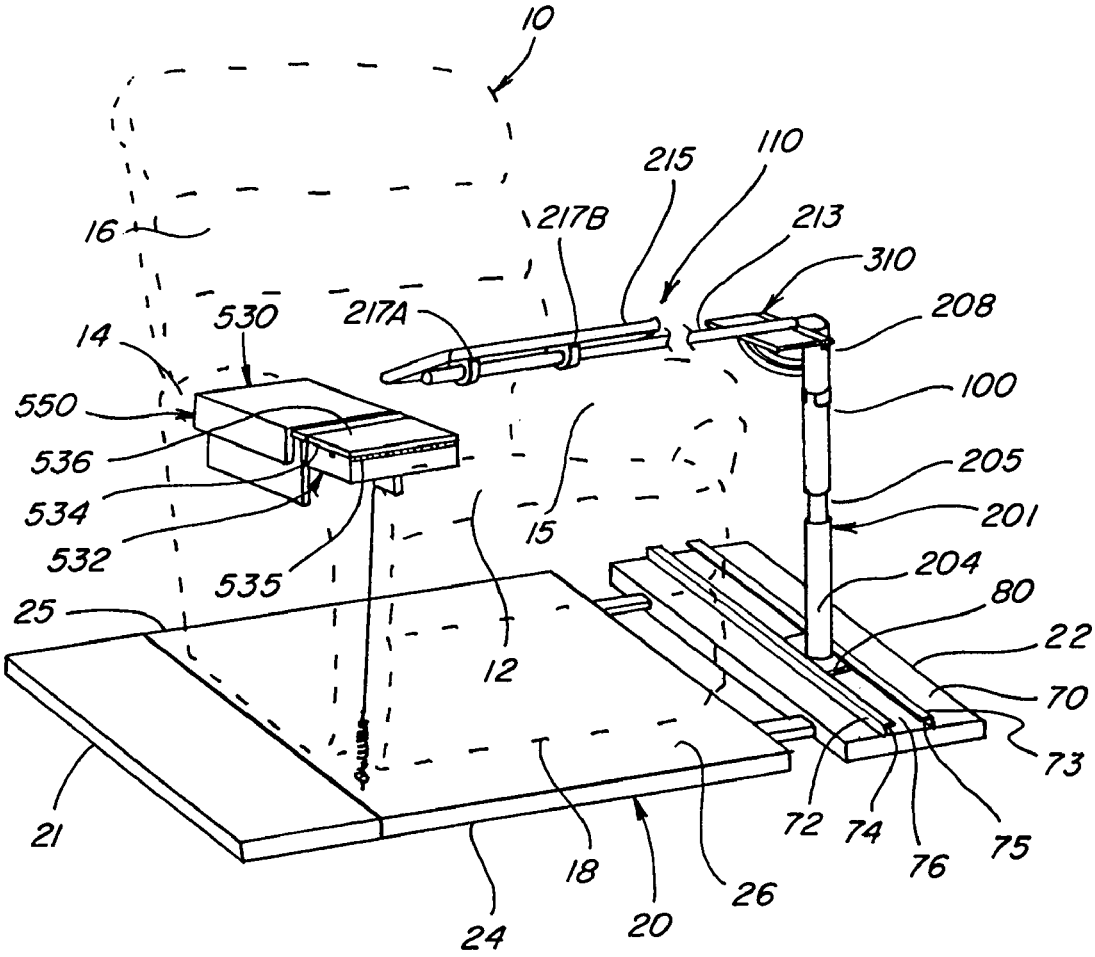
FIG. 12 is a perspective view similar to FIG. 1, but depicting a different preferred embodiment of the invention in association with an easy chair, as shown in phantom, with which the invention is employed.

FIG. 12 depicts another embodiment of the invention wherein the columnar element, the keyboard storage assembly, and the mouse storage assembly and pad area include additional features that offer further advantages, including advantages in convenience of use. In the embodiment of FIG. 12, columnar element 100 includes an adjustable column member 201 which has a lower portion 204 that has associated therewith a shoe 80 engageable with the channel cavity 76 of base portion 70. Such columnar element also includes a pneumatic height adjustment mechanism of any conventional design, as represented in such embodiment by the air cylinder 205 and the control lever 207 as depicted in greater detail in FIG. 13, which is operable by the user to control the height of the upper end 208 of adjustable column member 201. The upper end 208 of adjustable column member 201 is a form of cap that is dimensioned to fit over the top of the cylinder 205 and to ride on spaced bosses 203A and 203B disposed about the periphery of the outer body of cylinder 205 so that the cap will be rotatable about the axis of the column member 201.

The keyboard storage assembly 110 of such embodiment includes an arm 213 to which a keyboard platform 215 is adjustably secured, such as by pole gripping projections 217A and 217B on the bottom of the keyboard platform which are dimensioned to snap onto the arm 213 and to be both slidable therealong and rotatable thereon to reposition the keyboard platform 215. The gripping projections 217A and 217B are preferably of a design and construction that they will grip the arm element tightly enough to maintain the keyboard platform in a fixed position, yet will be flexible and resilient enough to permit the keyboard platform 215 to be repositioned by the application of a sliding or tilting force to the keyboard platform. If desired, locking means of any acceptable design could also be employed to lock the keyboard platform in a desired position.

Such keyboard storage assembly embodiment preferably also includes attachment or restraint means (not shown) associated with the upper surface of keyboard platform 215 for attaching a keyboard thereto or for restraining a keyboard in place thereon. Such attachment or restraint means can take many forms and can include, by way of example and not of limitation, clamping devices and mechanisms, locking pins, holding straps, and velcro-like attachments, as well as all other known manners of effecting like attachment or restraint of a keyboard to or on the keyboard platform.

Figure 13:
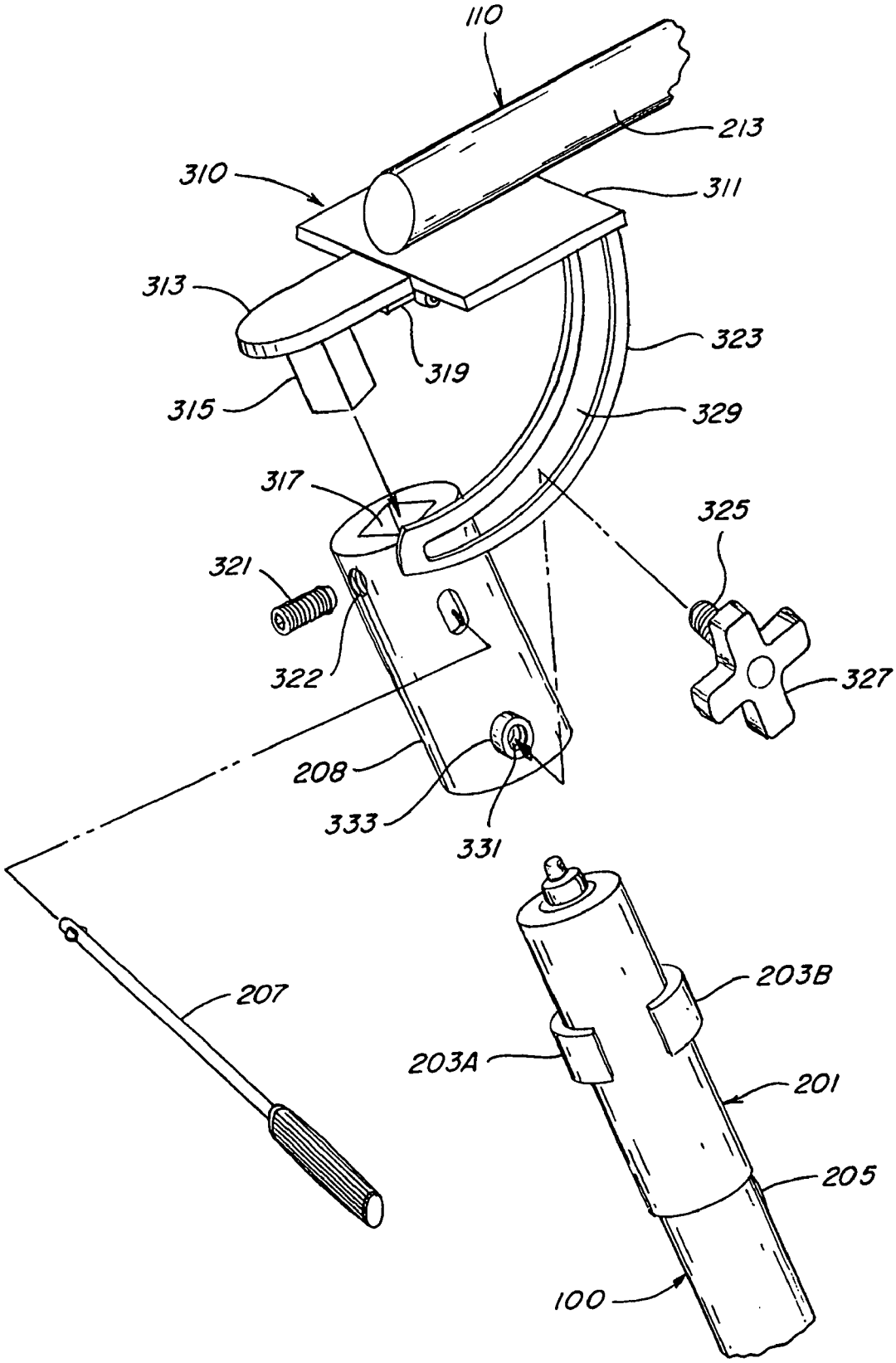
FIG. 13 depicts in greater detail the connection of the keyboard storage assembly of FIG. 12 to the columnar element.

The noted keyboard storage assembly 110 of FIGS. 12 and 13 is shown secured to columnar element 100 by way of a securing assemblage 310, as best shown in FIG. 13. Securing assemblage 310 includes a joinder plate 311 secured to arm 213, such as by a weld or many other suitable means to the same effect. Depending upon materials employed, arm 213 and joinder plate 311 could be molded or formed as a unitary unit. In the embodiment depicted, securing assemblage 310 also includes a cap mating member 313 having a depending stud 315 configured to be complementarily engageable with a cavity 317 in cap 208, and a hinge member 319 hingedly connecting joinder plate 311 and cap mating member 313. Optionally, a set screw 321 can be inserted through a threaded opening 322 in cap 208 to contact depending stud 315 to more securely mate cap mating member 313 to cap 208 and the columnar element 100. A depending slotted arc connector member 323, which is offset laterally from the connection line of arm 213 to joinder plate 311, depends from the bottom of joinder plate 311 and extends to abut a side of cap 208 when the keyboard storage assembly 110 is secured to columnar element 100 with arm 213 being in a generally horizontal position. In such a position, the threaded portion 325 of a locking handle 327 can be inserted through slot 329 of slotted arc connector 323 into the complementarily threaded cavity 331 of projection 333 along the side of cap 208, and the handle can be operated to pin the slotted arc connector member 323 between an inner surface of the locking handle 327 and the outer surface of projection 333, as can be observed in FIGS. 14 and 15, to lock the arm 213 in a generally horizontal position.

Figure 14:
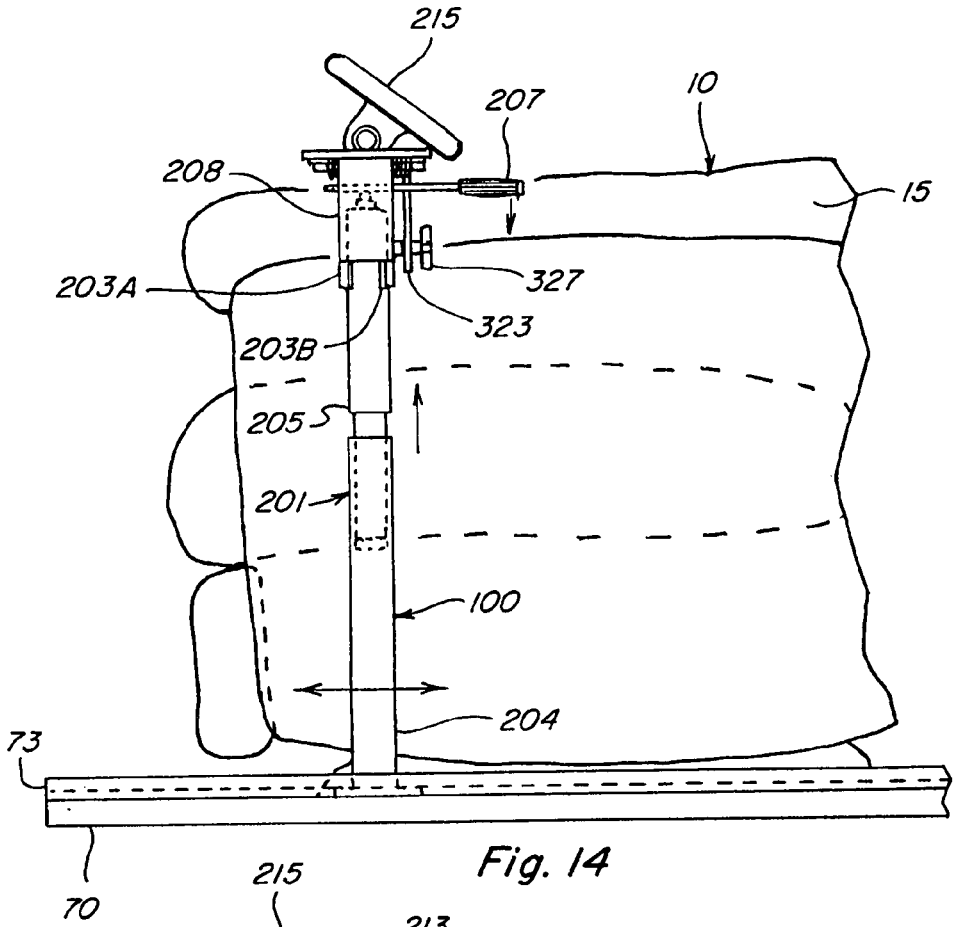
FIGS. 14-17 depict the keyboard storage assembly of FIG. 12 and several positionings thereof relative to the easy chair, with FIG. 15 being a perspective view looking forwardly from the rear of the chair and with the chair shown in phantom.
Figure 16:
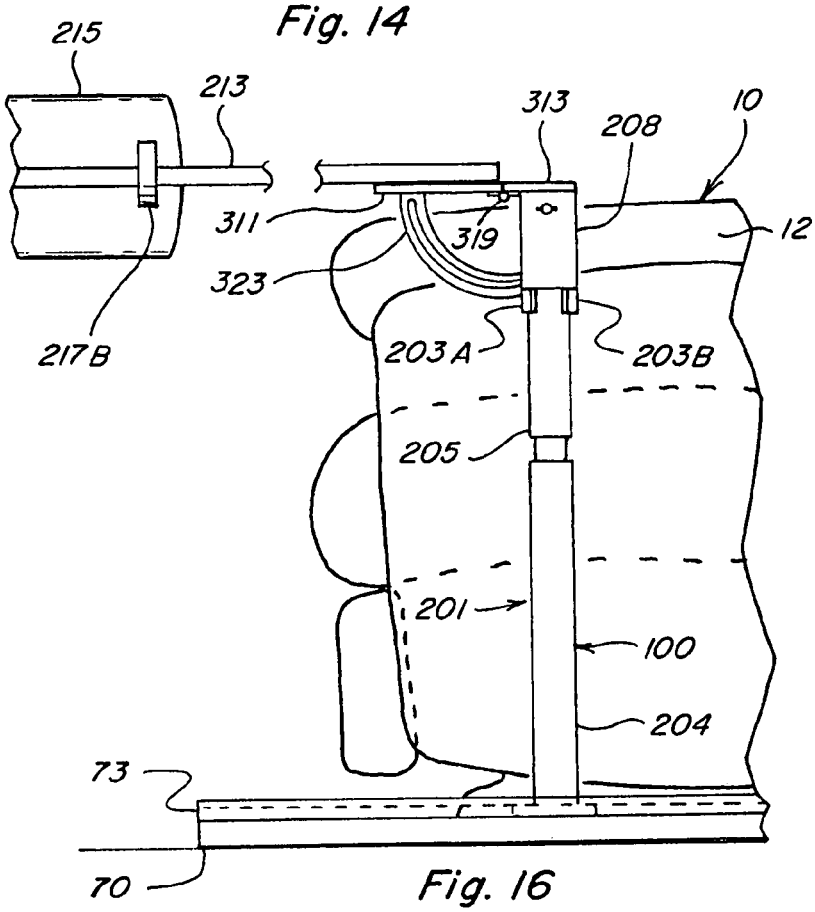
Figure 15:
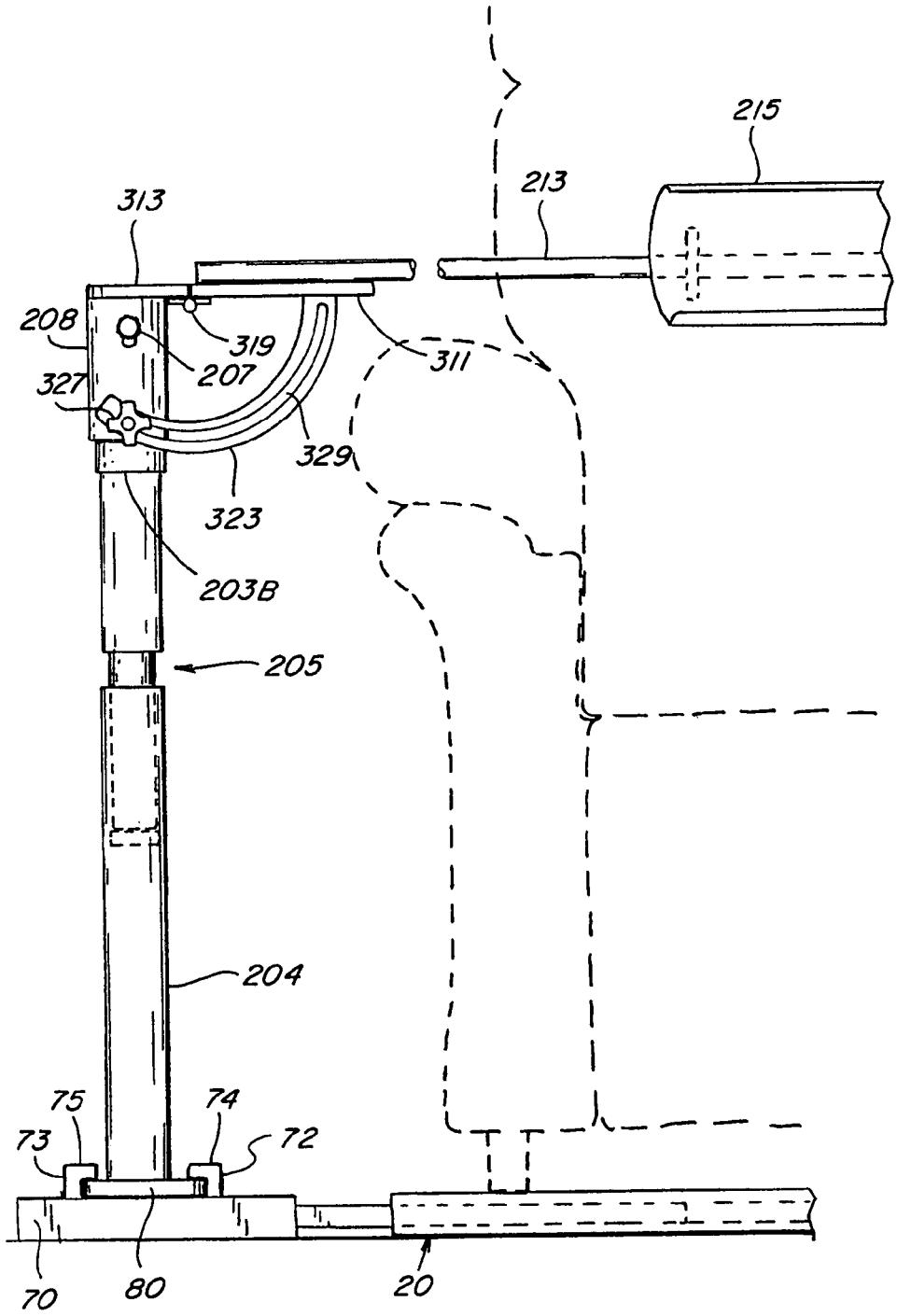
Figure 17:
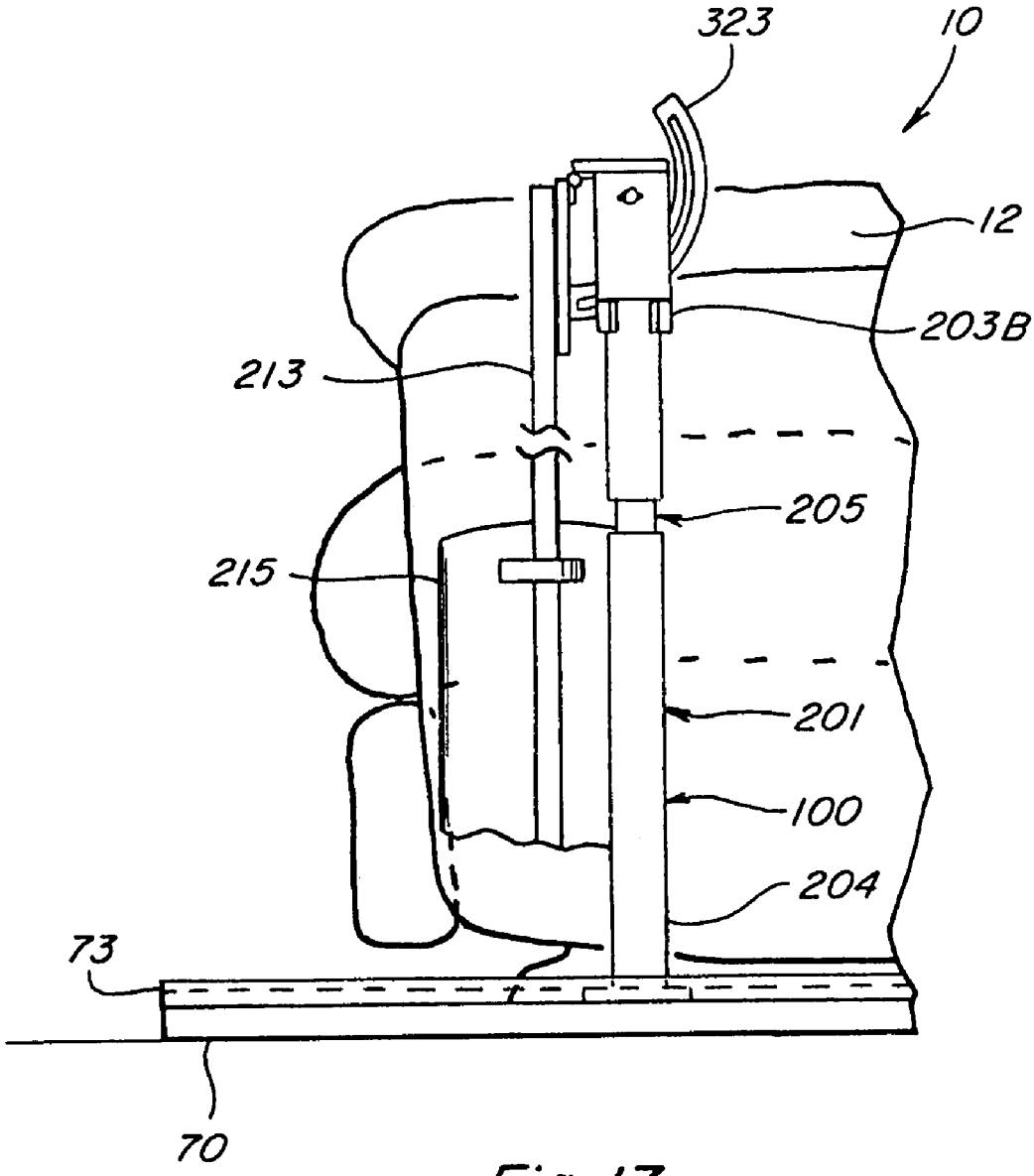
Figure 18:
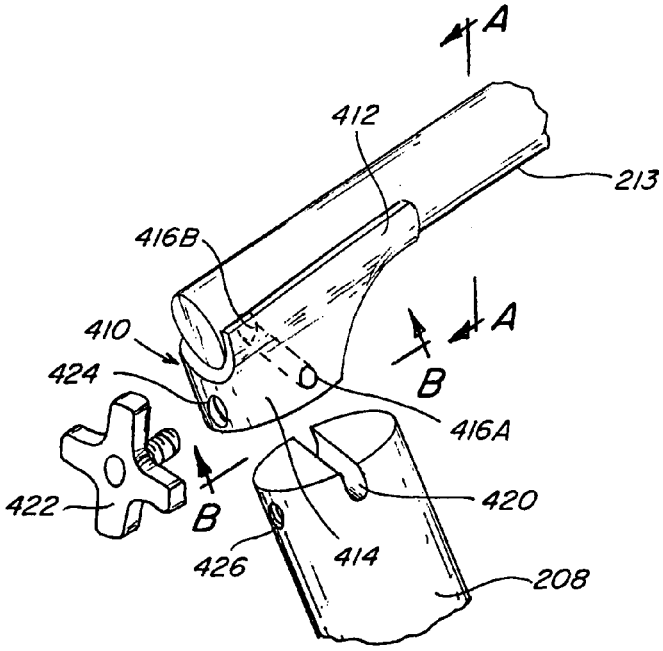
FIG. 18 depicts an alternative connection of a keyboard storage assembly to a columnar element.
Figure 19:
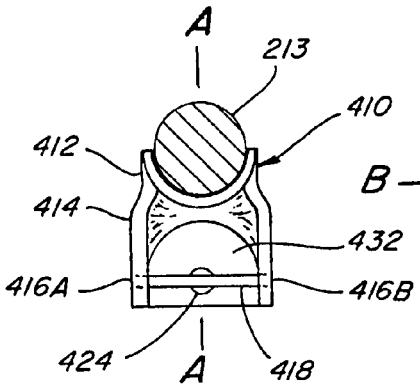
FIG. 19 depicts a view of the connector construction of FIG. 18 along cut A-A of FIG. 18.
Figure 20:
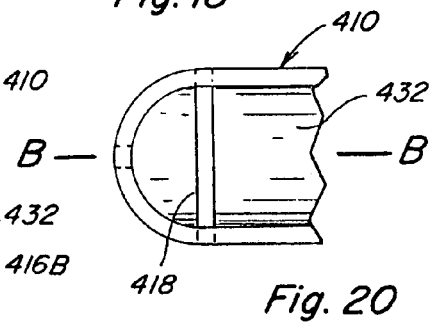
FIG. 20 depicts a view of the connector construction of FIG. 18 along cut B-B of FIG. 18.

FIG. 14 depicts the embodiment of FIG. 12 as observed from the left side of the chair such as when the keyboard storage assembly is positioned for use by a user seated in the chair 10, and FIG. 15 depicts the same embodiment from a point to the rear of the chair (with the chair shown in phantom). When the user wishes to discontinue use of the keyboard, arm 213 (and cap 208 to which it is mated) may then be rotated about the axis of adjustable column member 201 to a position such that arm 213 is generally parallel to the side of the chair, and keyboard platform 215 can be slidably and rotatably adjusted on arm 213 to position keyboard platform in a generally vertical position, such as is depicted in FIG. 16. When locking handle 327 is then loosened, joinder plate member 311, and arm 213 and the components secured thereto, can be pivoted downwardly about the pivot connection or hinge axis of hinge member 319, with the threaded portion 325 of locking handle 327 riding along slot 329 of slotted arc connector 331, to a storage position such as is depicted in FIG. 17.

Figure 21:
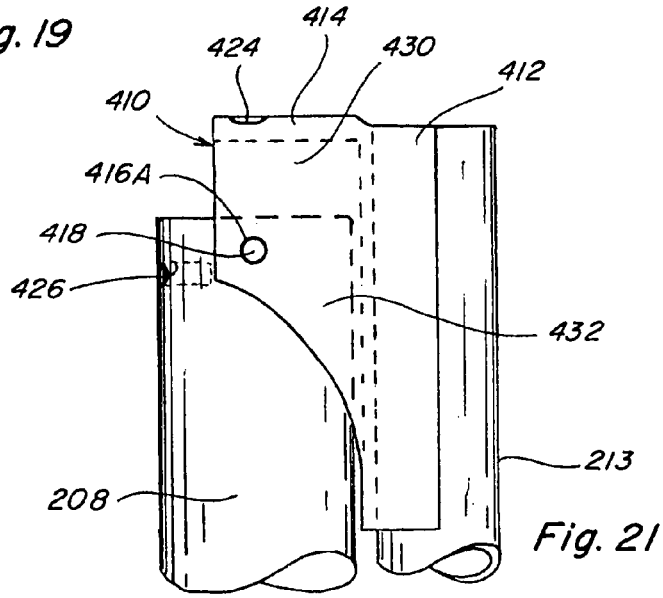
FIG. 21 depicts the connector construction of FIG. 18 when the arm of the keyboard storage assembly has been rotated and positioned to abut the columnar element in a storage position.

FIGS. 18-21 depict an alternative securing assemblage 410 such as might be formed at the inner end of arm 213 or attached thereto, such as by a molding process in which the arm 213 and securing assemblage 410 are formed as essentially a unitary member. Securing assemblage 410 includes a cap mating portion 412 which is connected along its top portion to arm 213 and has a depending portion 414 formed to partially encircle the cap 208 with aligned holes 416A and 416B on opposite sides thereof for holding a pin member 418 insertable therethrough and alignable with a groove 420 in the cap 208. The securing assemblage 410 may be conveniently mountable with the cap 208 with pin member 418 resting in groove 420 and the depending portion 414 partially encircling cap 208. Preferably, a locking member 422 may be provided to be insertable through a hole 424 in the outer wall of depending portion 414 to register with a hole 426 to lock the securing assemblage 410 in place with arm 213 in an extended, substantially horizontal position. In the embodiment of the securing assemblage 410 depicted, a vaulted chamber 432 is formed within the closed end of depending portion 414 and is dimensioned to fit conformably about a side of the cap 208 when securing assemblage 410 has been rotated about pin member 418 to a position as depicted in FIG. 21.

Figure 22:
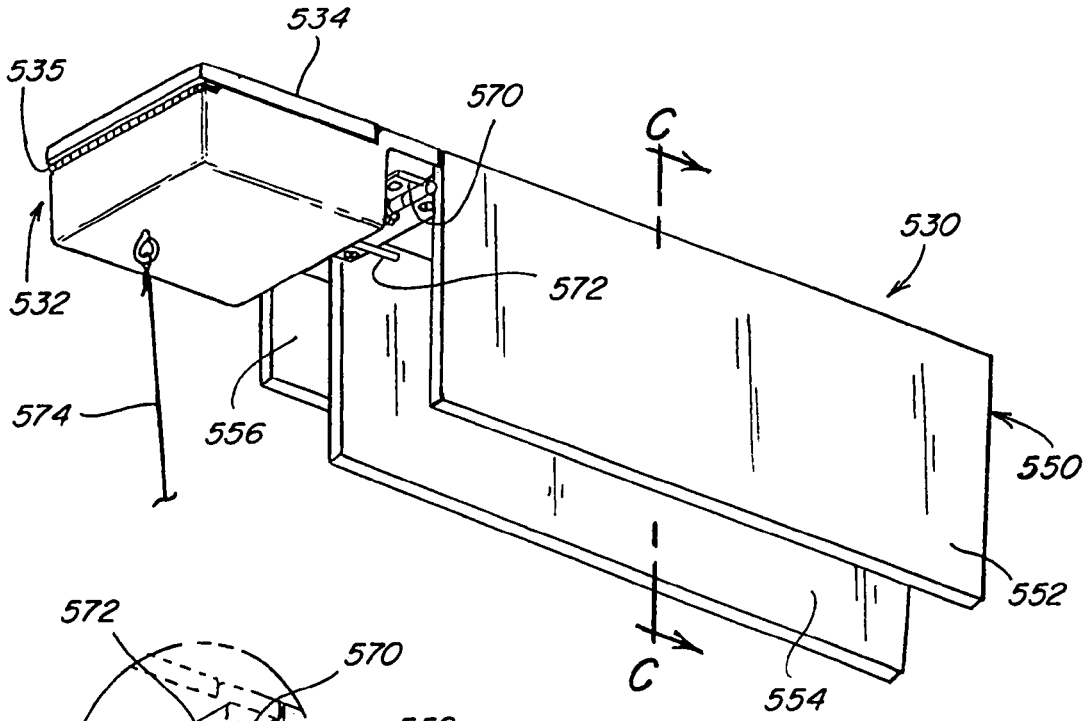
FIG. 22 is a perspective view depicting in greater detail the mouse storage assembly and pad area of FIG. 12.
Figure 23:
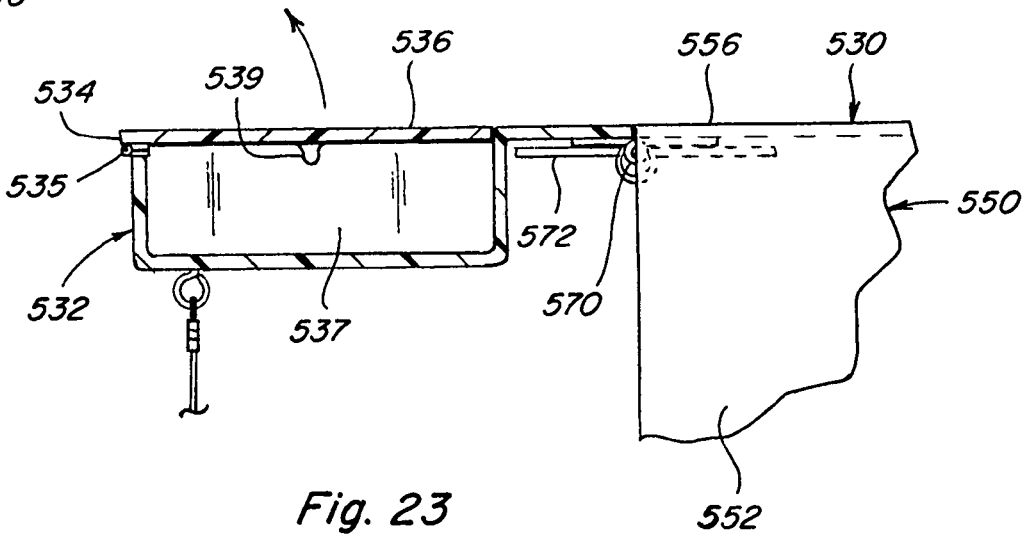
FIG. 23 is a partial cutaway view of the mouse storage compartment of FIG. 22 as connected to the mounting assembly of FIG. 22.

FIG. 22 depicts in greater detail the mouse storage assembly and pad area 530 of FIG. 12, including a mouse storage compartment portion 532 having a fitted lid 534 secured by a hinge 535 such that the lid 534 can be conveniently opened and closed. Lid 534, which has a generally flat upper surface 536 upon which the mouse may be placed for use, is rotatably openable and closable about the hinge axis of hinge 535 for access to an interior 537, as better shown in FIG. 23, of mouse storage compartment portion 532, which interior 537 is dimensioned to able to hold a computer mouse therein for storage. As best shown in FIG. 23, which is a partial side view of the mouse storage assembly and pad area 530, with the mouse storage compartment portion 532 shown in cutaway, a side wall of the mouse storage compartment portion 532 preferably includes a slot 539 therein for the mouse wire when the computer mouse is a wired mouse connected to the computer.

Figure 25:
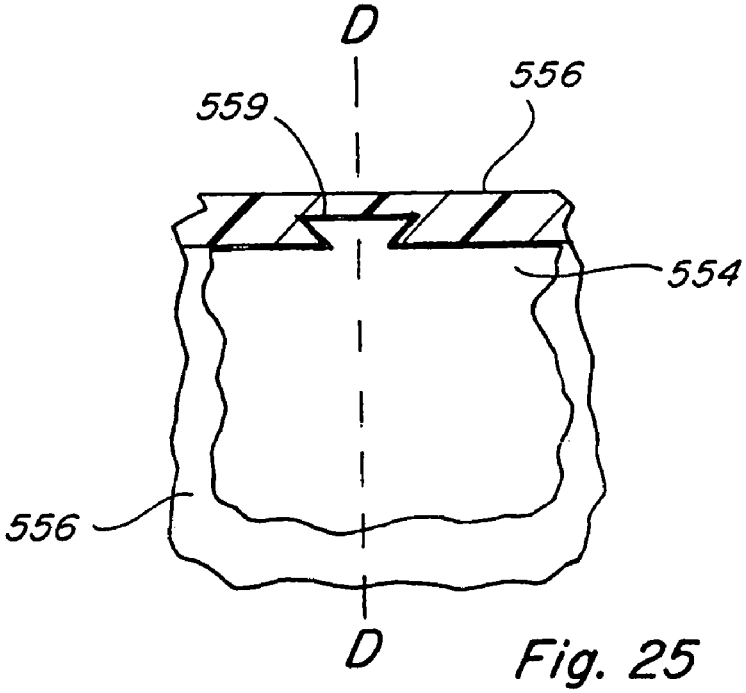
FIG. 25 is a sectional view as taken of cut D-D of FIG. 24, better depicting the dado and groove connection.
Figure 24:
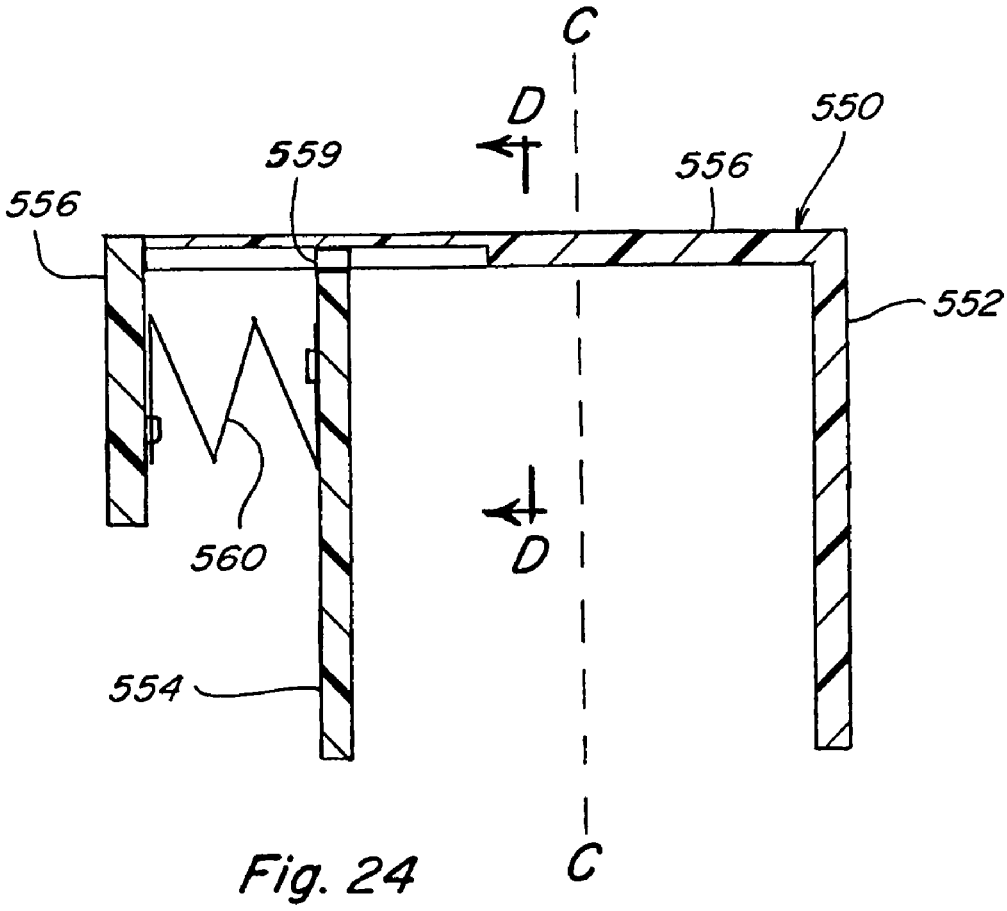
FIG. 24 is a sectional view as taken of cut C-C of FIG. 22.

In such mouse storage assembly and pad area 530 embodiment, a mounting assembly 550 is provided for attaching the mouse storage assembly and pad area 530 to the chair 10. Such mounting assembly has a generally U-shaped configuration, as best shown in FIG. 24, in which a first, fixed side portion 552 is provided which is positionable against the interior side of an arm of the chair 10 and a second, laterally movable side portion 554 is positionable generally adjacent the outer side of the arm of the chair 10, with a top portion 556 interconnecting the side portions 552 and 554, and with top portion 556 projecting outwardly from movable side portion 554 to a fixed stop portion 558. A biasing element 560 is connected to bias side portion 554 away from fixed stop portion 558, with side portion 554 and top portion 556 being connected to one another by a dado and groove connection 559 such as is depicted in FIG. 25 to allow lateral movement of side portion 554 relative to side portion 552 and 556 and slidable movement of side portion 554 relative to top portion 556.

Figure 26:
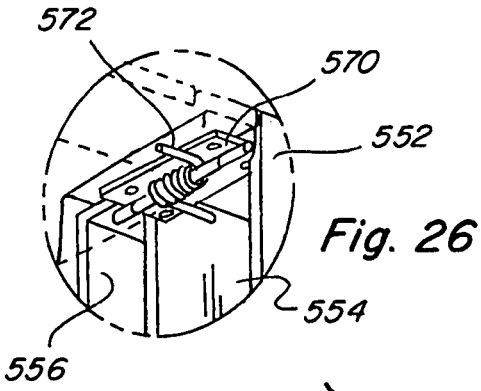
FIG. 26 is an expanded, perspective view of the hinge and first biasing element of FIG. 22, depicting such elements in greater detail.
Figure 27:
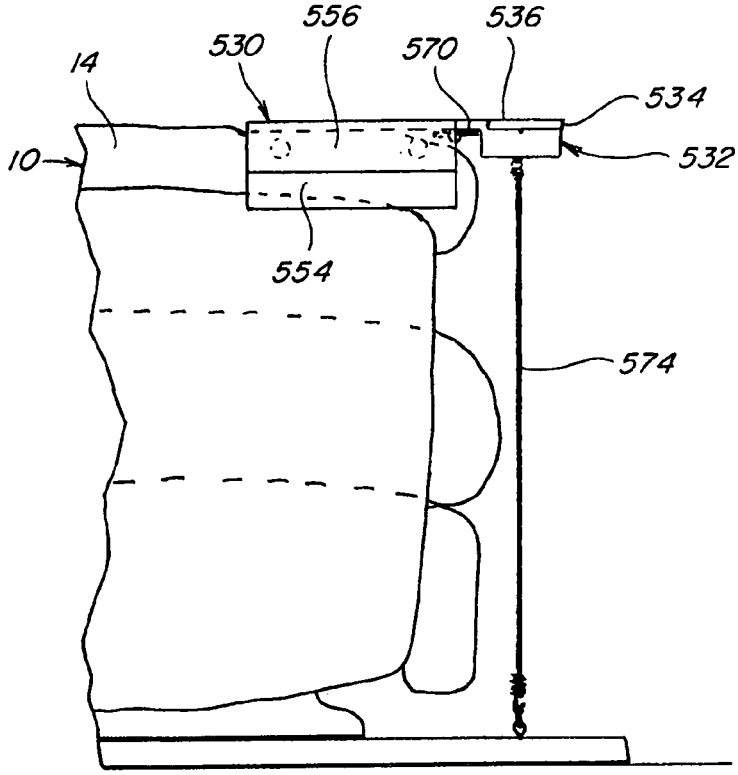
FIGS. 27-28 depict the manner in which the hinge and biasing elements of the mouse storage assembly and pad are of FIG. 22 function to maintain the upper surface of the lid of the mouse storage compartment substantially horizontal when the easy chair is placed in a reclined position with the arm thereof inclined.
Figure 28:
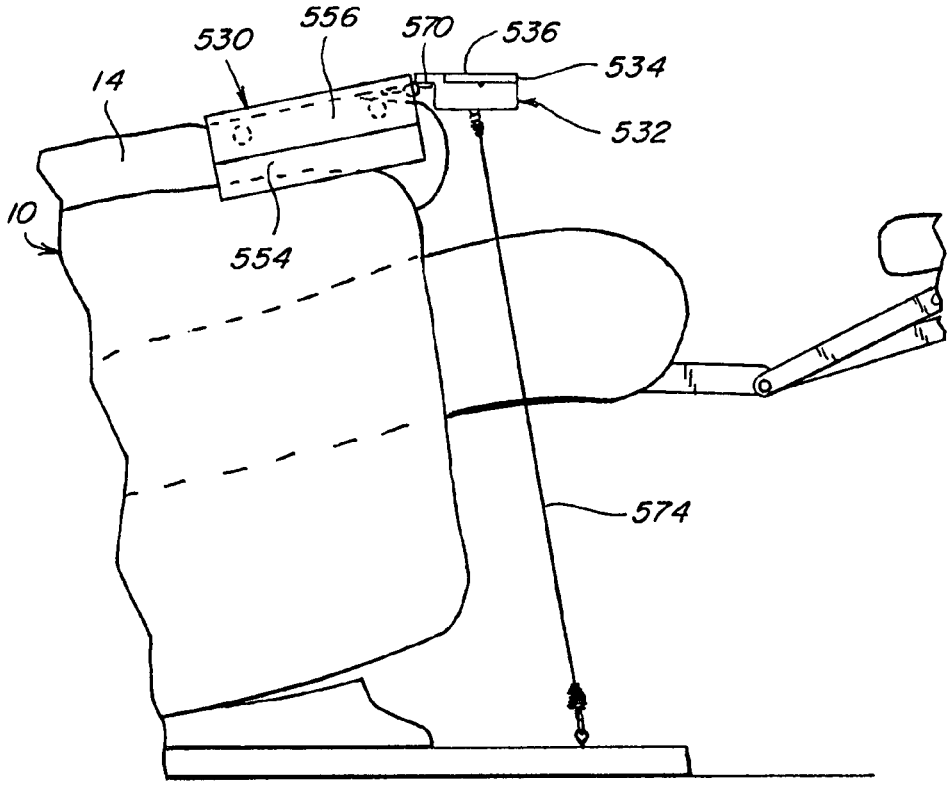

As shown in FIGS. 23 and 26, mouse storage compartment portion 532 is connected to mounting assembly 550 by a hinge member 570 which has associated therewith a first biasing element 572 for biasing the mouse storage compartment portion 532 towards a clockwise rotation about the hinge axis. A second biasing or tensioning element 574 is attachable to mouse storage compartment portion 532 and to a fixed base point near the base of the chair 10 to act against the bias of first biasing element 572 and to maintain the upper surface 536 of the fitted lid 534 of the mouse storage compartment portion 532 generally level when the mouse storage assembly and pad area 530 is mounted on the arm 14 of the chair 10 and the tensioning element 574 is connected between the mouse storage compartment portion 532 and the fixed base point, even if the chair is reconfigured to be in a reclined position, as illustrated by FIGS. 27 and 28. In such event, the hinged connection of the mouse storage compartment portion 532 to mounting assembly 550 and the biasing elements permit rotational movement of elements of the mouse storage compartment portion 532 and mounting assembly 550 about the hinge axis of hinge member 570 while maintaining the upper surface 536 of lid 534 generally horizontal.

With such mouse storage assembly and pad area embodiment, a user can easily mount the mouse storage assembly and pad area 530 by position the mouse storage compartment portion 532 on an arm 14 of chair 10 with side portion 552 abutting the inside of such arm, with top portion 556 extending across the top of such arm, and with side portion 554 being slidably positioned beyond the outer side of such chair arm towards fixed stop portion 556 by a user. The user may then slidably adjust the side portion 554 towards the outer side of the chair arm until side portion 554 engages the outer side of the chair arm and biasing element 560 acts against side portion 554 to exert a clamping pressure thereon to clamp the chair arm between side portions 552 and 554.

Figure 29:
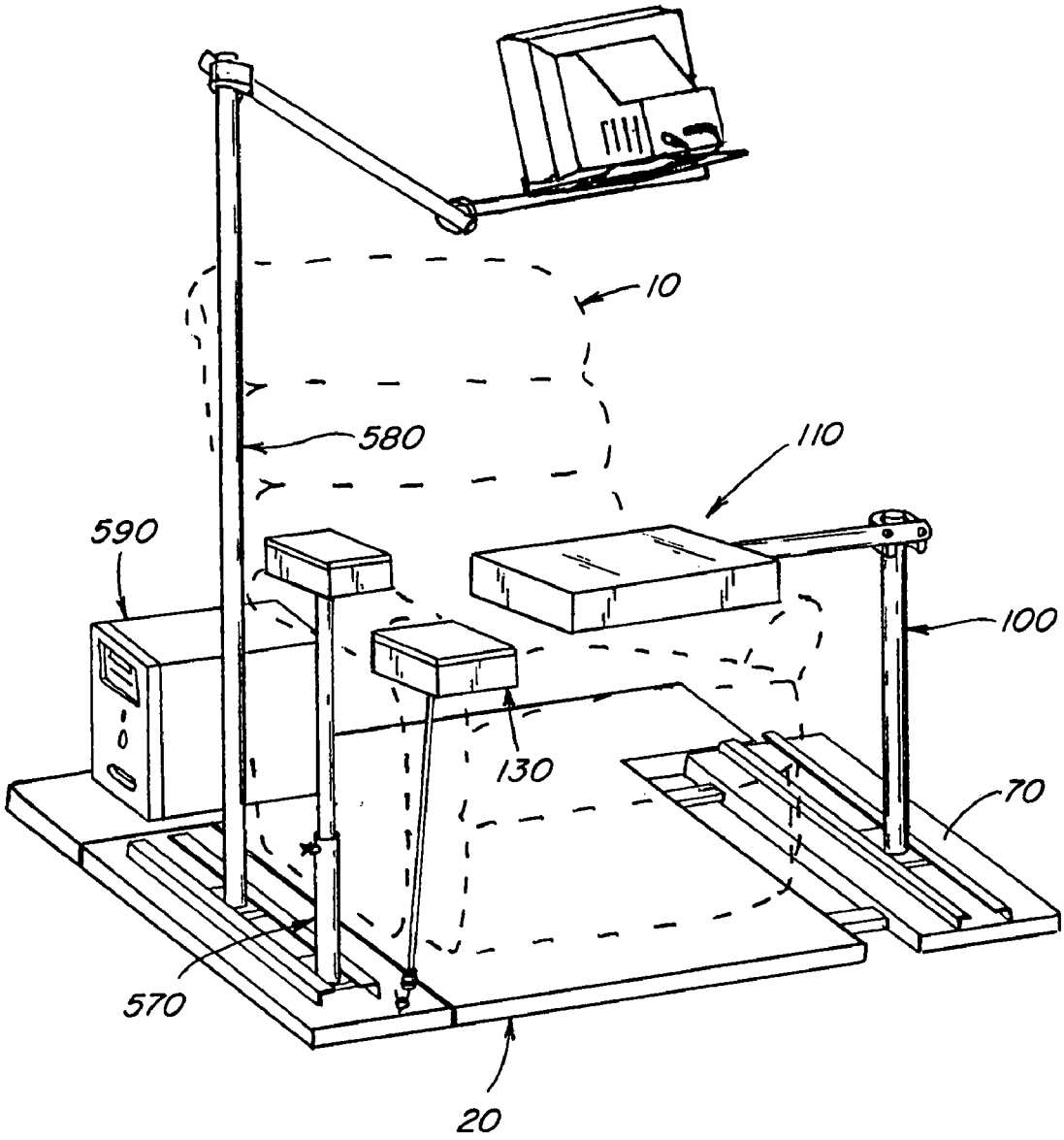
FIG. 29 is a perspective view similar to FIG. 1, but also depicting in generic fashion several optional elements that may be provided as enhancements to the kit for converting an easy chair for use with a computer system.

As shown in FIG. 29, if desired, additional columnar elements for attachment to the base member, or additional chair mounted assemblies, may be provided, and may have associated therewith various types of drive members, such as additional hard drives, CD drives, or DVD drives, or various other peripherals or associated equipment, including devices such as modems, switches and gateways, all of which, for convenience of reference herein. should be considered encompassed by the term drive members, that can be positionable within convenient reach of a user seated in the chair, as is illustrated generically by assembly 570. Similarly, a computer monitor support, which could take the form of any of numerous constructions that are already well known in the art, could be provided for positioning a computer monitor at a desired position for viewing, as is illustrated generically by assembly 580, and mounting positions for the CPU unit of the base computer or for speakers, or drive members could be provided on the base member or elsewhere, such as at a convenient location generally behind the chair, as is illustrated generically by assembly 590.

From the foregoing, it will be appreciated that there has thus been described apparatus for use in converting an armchair for use as a computer workplace, particularly as such apparatus may be provided in a kit form, as well as both the use thereof to convert the armchair to a computer workplace chair and the resultant computer workplace chair construction that provides to a user a comfortable and convenient computer chair construction. As will be apparent to those skilled in the art, however, many changes, modification, and enhancements may be made to the invention as described hereinabove without departing from the spirit and scope of the invention, and all such changes, modifications and enhancements are deemed covered by the invention, which is limited only by the claims which follow.

What I claim is:

1. A kit for converting an arm chair for use with a computer system that includes a keyboard and mouse, and for storage of the keyboard and mouse when not in use, comprising a plurality of kit elements including:

a base member having a low profile configured to fit and extend beneath at least a portion of the bottom of the arm chair, said base member including a stabilizing portion to maintain said base member in a generally stable position in a generally fixed relationship with the arm chair when said base member and the arm chair are securably associated with one another, and opposed side portions, at least one of said side portions projecting laterally beyond a side of the arm chair and defining a base support portion, a columnar element having a bottom portion complementarily engageable with said base support portion of said base member and a body portion extending upwardly from said base support portion to an upper end above the level of one of the arms of the arm chair, such arm being designated as the keyboard arm of the arm chair, a keyboard storage assembly associatable with said columnar element, said keyboard storage assembly including at least one arm element positionable at a height along the columnar element above the level of the keyboard arm of the arm chair and securable to said columnar element, said arm element projecting generally laterally from said columnar element and including a keyboard retaining portion for engagably receiving a keyboard and maintaining the keyboard when it is desired to store the keyboard, said arm element being generally horizontally movable relative to said columnar element to position the keyboard storage assembly generally in front of a user seated in the arm chair when use of the keyboard is desired by the seated user and to reposition said arm element to a position generally parallel to the keyboard arm of the arm chair at other selectable times, a mouse storage assembly and pad area including a mouse compartment body defining a mouse compartment sized to accommodate a mouse therein and a fitted mouse compartment lid therefor to cover and close said mouse compartment, including when a mouse is positioned in the mouse compartment for storage, said mouse lid being openable and closable as desired by a user and having a generally flat upper surface suitable for use as a mouse pad area when the mouse compartment lid is closed and the mouse is in use, said mouse storage assembly and pad area including a mounting assembly for securably associating said mouse storage assembly and pad area to an arm of the arm chair, such arm being designated the mouse arm of the arm chair, with the upper surface of said lid being generally longitudinally alignable with the reach of the arm of the arm chair, said kit elements being assembleable with one another and the arm chair to effect an chair construction with the keyboard and mouse of the computer system being located for easy access and use by a user seated in such arm chair.

2. The kit of claim 1 wherein said side portions of said base member are adjustably spaceable from one another.

3. The kit of claim 1 wherein said stabilizing portion of said base member includes a connector element configured to be connectable to a leg of the arm chair.

4. The kit of claim 1 wherein said base member includes a central portion between said side portions, said central portion being weighted to stabilize the position of the base member upon an underlying surface and to act as said stabilizing portion.

5. The kit of claim 4 wherein said central portion of said base member extends beneath the legs of the arm chair and is securable to the arm chair.

6. The kit of claim 4 wherein said central portion of said base member extends beneath the legs of the arm chair and includes a surface preparation in the area upon which the legs of the arm chair would rest to inhibit sliding movement of the legs upon said base member.

7. The kit of claim 4 wherein said central portion of said base member extends beneath the legs of the arm chair and includes mating portions therein for receiving the legs of the arm chair.

8. The kit of claim 1 wherein said body portion of said columnar element includes a telescoping portion operable to telescopically vary the distance between said bottom portion and said upper end of said columnar element.

9. The kit of claim 8 wherein said columnar element includes a locking mechanism for locking the telescoping portion in a desired telescopic condition.

10. The kit of claim 8 wherein said telescoping portion includes a pneumatic piston mechanism operable by a user to adjust the extended height of said columnar element.

11. The kit of claim 1 wherein said arm element of said keyboard storage assembly includes a joint assembly operable to maintain the keyboard within said keyboard retaining portion in a generally vertical plane adjacent said columnar element and the side of the arm chair when it is desired to store the keyboard.

12. The kit of claim 11 wherein said joint assembly is operable in three dimensions of movement to move said keyboard retaining portion from a position with the keyboard within said keyboard retaining portion in a generally vertical plane adjacent said columnar element and the side of the arm chair when it is desired to store the keyboard to a position in which the keyboard retaining portion is disposed extending cross-wise across the seat of the arm chair in front of a user sitting in such seat.

13. The kit of claim 12 wherein said keyboard retaining assembly includes a surface upon which the keyboard may be positioned for access by and use by a user when the keyboard retaining portion is disposed extending cross-wise across the seat of the arm chair in front of a user sitting in such seat.

14. The kit of claim 13 wherein said surface is slidable forwardly and backwardly to adjust the position thereof to a more desirable position relative to the user.

15. The kit of claim 13 wherein said surface is tiltable upwardly and downwardly to adjust the orientation thereof to a more desirable orientation relative to the user.

16. The kit of claim 13 wherein said surface includes a keyboard retainer for securing the keyboard to said surface when the keyboard is to be stored.

17. The kit of claim 13 wherein said keyboard retaining portion includes a keyboard compartment into which the keyboard can be placed for storage, said surface upon which the keyboard may be positioned for access by and use by a user being an outer surface of said keyboard compartment.

18. The kit of claim 17 wherein said keyboard compartment includes a closure for closing said keyboard compartment when the keyboard is stored therein.

19. The kit of claim 1 wherein said mouse storage assembly and pad area includes a leveling assemblage for maintaining the mouse pad area in a generally horizontal position if the mouse arm of the arm chair is placed into an inclined position.

20. The kit of claim 19 wherein said leveling assemblage includes a hinge member having a hinge axis generally horizontally transverse to the mouse arm of the arm chair and between said mouse pad area and the mouse arm of the arm chair, about which hinge axis the mouse pad area can rotate relative to the mouse arm of the arm chair, and first and second biasing members, one of said biasing members being operatively connectable between said mouse pad area and a fixed point at said base member and the other of said biasing members being associated with said hinge member to act against the bias of said first biasing member, the bias of said biasing members working against one another to effect rotation of said mouse pad area relative to the mouse arm of the arm chair at said hinge axis to maintain the mouse pad area in a generally horizontal position if the mouse arm of the arm chair is inclined while the mouse storage assembly and pad area is mounted to the mouse arm of the arm chair.

21. The kit of claim 20 wherein said mouse pad area projects beyond the front of the mouse arm of the arm chair as a forward extension thereof when the mouse storage assembly and pad area is mounted to the arm of the arm chair, the upper surface of said lid being generally horizontally alignable with the top of the mouse arm of the arm chair when the mouse arm of the arm chair is disposed in a generally horizontal position.

22. The kit of claim 20 wherein said mounting assembly for the mouse storage assembly and pad area includes an arm clamp portion engageable with the mouse arm of the chair and said hinge member connects said arm clamp portion to said mouse compartment body.

23. The kit of claim 1 wherein said mounting assembly for said mouse storage assembly and pad area includes a mounting construction having a lower end portion securable to the base of the arm chair and an upper end portion securable to said compartment body.

24. The kit of claim 1 wherein said mounting assembly for said mouse storage assembly and pad area includes a mounting construction having a lower portion thereof securable to the seat portion of the arm chair and an upper end portion securable to said compartment body.

25. The kit of claim 1 wherein said mounting assembly for said mouse storage assembly and pad area includes a mounting construction securable to the mouse arm of the arm chair and to said mouse compartment body.

26. The kit of claim 1 wherein said mouse compartment lid is hingedly attached to said mouse compartment body.

27. The kit of claim 1 wherein said kit elements further include a drive storage assembly associatable with the arm chair.

28. The kit of claim 1 wherein said kit elements further include a monitor mounting assembly including an extensible pole-like element complementarily engageable with said base member and a mounting attachment associated with said pole-like element for securing a monitor at an elevated level for viewing, said mounting attachment being configurable to position a secured monitor in a desirable position for viewing by a user of the arm chair.

29. A method for converting an arm chair for use with a computer system that includes a keyboard and mouse, comprising providing a base member having a low profile configured to fit and extend beneath at least a portion of the bottom of the arm chair, said base member including a stabilizing portion to maintain said base member in a generally stable position in a generally fixed relationship with the arm chair when said base member and the arm chair are securably associated with one another, and opposed side portions, at least one of said side portions projecting laterally beyond a side of the arm chair and defining a base support portion, securably associating said base member with the arm chair, providing a columnar element having a bottom portion complementarily engageable with said base support portion of said base member and a body portion extending upwardly from said base support portion to an upper end above the level of one of the arms of the arm chair, such arm being designated as the keyboard arm of the arm chair, engaging said columnar element with said base support portion to position said upper end of said columnar element above the level of the keyboard arm of the arm chair, providing a keyboard storage assembly associatable with said columnar element, said keyboard storage assembly including at least one arm element positionable at a height along the columnar element above the level of the keyboard arm of the arm chair and securable to said columnar element, said arm element projecting generally laterally from said columnar element and including a keyboard retaining portion for engagably receiving a keyboard and maintaining the keyboard when it is desired to store the keyboard, said arm element being generally horizontally movable relative to said columnar element to position the keyboard storage assembly generally in front of a user seated in the arm chair when use of the keyboard is desired by the seated user and to reposition said arm element to a position generally parallel to the keyboard arm of the arm chair at other selectable times, securing said arm element to said columnar element at a desired height, providing a mouse storage assembly and pad area including a mouse compartment body defining a mouse compartment sized to accommodate a mouse therein and a fitted mouse compartment lid therefor to cover and close said mouse compartment, including when a mouse is positioned in the mouse compartment for storage, said mouse lid being openable and closable as desired by a user and having a generally flat upper surface suitable for use as a mouse pad area when the mouse compartment lid is closed and the mouse is in use, said mouse storage assembly and pad area including a mounting assembly for securably associating said mouse storage assembly and pad area to an arm of the arm chair, such arm being designated the mouse arm of the arm chair, with the upper surface of said lid being generally longitudinally alignable with the reach of the arm of the arm chair, securably associating said mouse storage assembly and pad area to the arm chair.

30. A computer chair assembly for use with a computer system that includes a keyboard and a mouse, comprising a chair having a bottom portion, a seat, and a pair of arms and a back, said bottom portion including a plurality of legs supporting said seat, and said arms and back being operatively attached to said seat, said arms defining respective sides of said chair, a base member having a low profile configured to fit and extend beneath at least a portion of the bottom of said chair and opposed side portions, said base member including a stabilizing portion securably associating said base member and said chair with one another to maintain said base member in a generally stable position in a generally fixed relationship with said chair, at least one of said side portions projecting laterally beyond a side of said chair and defining a base support portion, a columnar element having a bottom portion complementarily engaged with said base support portion of said base member and a body portion extending upwardly from said base support portion to an upper end above the level of one of the arms of said chair, such arm being designated as the keyboard arm of said chair, a keyboard storage assembly associated with said columnar element, said keyboard storage assembly including at least one arm element positioned at a height along said columnar element above the level of the keyboard arm of said chair and secured to said columnar element, said arm element projecting generally laterally from said columnar element and including a keyboard retaining portion for engagably receiving a keyboard and maintaining the keyboard when it is desired to store the keyboard, said arm element being generally horizontally movable relative to said columnar element to position the keyboard storage assembly generally in front of a user seated in the arm chair when use of the keyboard is desired by the seated user and to reposition said arm element to a position generally parallel to the keyboard arm of the arm chair at other selectable times, a mouse storage assembly and pad area including a mouse compartment body defining a mouse compartment sized to accommodate a mouse therein and a fitted mouse compartment lid therefor to cover and close said mouse compartment, including when a mouse is positioned in the mouse compartment for storage, said mouse lid being openable and closable as desired by a user and having a generally flat upper surface suitable for use as a mouse pad area when the mouse compartment lid is closed and the mouse is in use, said mouse storage assembly and pad area including a mounting assembly securably associating said mouse storage assembly and pad area to an arm of said chair, such arm being designated the mouse arm of said chair, with the upper surface of said lid being generally longitudinally aligned with the reach of mouse arm of said chair.

* * * * *